US012139368B2

(12) United States Patent
Ash et al.

(10) Patent No.: US 12,139,368 B2
(45) Date of Patent: Nov. 12, 2024

(54) DEVICES FOR CABLE MANAGEMENT

(71) Applicant: Outdoor Wireless Networks LLC, Claremont, NC (US)

(72) Inventors: Marcus J. Ash, Manhattan, IL (US); Syed B. Abbas, Chicago, IL (US); Jose A. T. Rabello, Orland Park, IL (US); Brian Spinks, Woodridge, IL (US); Michael R. Schaefer, Tinley Park, IL (US); Bhavin Kadakia, Plainfield, IL (US)

(73) Assignee: Outdoor Wireless Networks LLC, Claremont, NC (US)

( * ) Notice: Subject to any disclaimer, the term of this patent is extended or adjusted under 35 U.S.C. 154(b) by 284 days.

(21) Appl. No.: 17/735,340

(22) Filed: May 3, 2022

(65) Prior Publication Data

US 2022/0259004 A1 Aug. 18, 2022

Related U.S. Application Data

(62) Division of application No. 16/777,311, filed on Jan. 30, 2020, now Pat. No. 11,345,564.
(Continued)

(51) Int. Cl.

| | |
|---|---|
| ***B65H 75/14*** | (2006.01) |
| ***B65H 75/18*** | (2006.01) |
| ***B65H 75/28*** | (2006.01) |

(52) U.S. Cl.
CPC ..... *B65H 75/28* (2013.01); *B65H 75/185* (2013.01)

(58) Field of Classification Search
CPC .... B65H 75/14; B65H 75/141; B65H 75/145; B65H 2701/534
See application file for complete search history.

(56) References Cited

U.S. PATENT DOCUMENTS

| | | | |
|---|---|---|---|
| 2,521,226 | A | 9/1950 | Keller |
| 4,938,432 | A | 7/1990 | Kurt et al. |

(Continued)

FOREIGN PATENT DOCUMENTS

| | | | |
|---|---|---|---|
| JP | 2919344 | B2 | 7/1999 |
| WO | 2013044100 | A1 | 3/2013 |
| WO | 2015086043 | A1 | 6/2015 |

OTHER PUBLICATIONS

Extended European Search Report mailed on Jul. 20, 2022 for corresponding European Application No. 20747594.8.

(Continued)

*Primary Examiner* — Sang K Kim
(74) *Attorney, Agent, or Firm* — Myers Bigel, P.A.

(57) ABSTRACT

The present disclosure describes a cable reel. The cable reel may include a hollow core having a width; a first wall coupled to an end of the core and extending radially outward a distance from the core, the first wall comprising an opening aligned with the hollow core and at least one support member extending across the opening; and a second wall coupled to an opposing end of the core and extending radially outwardly a distance from the core, the second wall comprising an opening aligned with the hollow core; wherein the first wall and the second wall form a gap therebetween equal to the width of the core, the gap being configured to hold a length of excess cable wrapped around the core. Cable reel covers are also described.

12 Claims, 19 Drawing Sheets

Related U.S. Application Data

(60) Provisional application No. 62/871,398, filed on Jul. 8, 2019, provisional application No. 62/800,011, filed on Feb. 1, 2019.

(56) References Cited

U.S. PATENT DOCUMENTS

| | | | | |
|---|---|---|---|---|
| 5,062,580 | A * | 11/1991 | Meagher | B65H 75/141 242/138 |
| 6,048,211 | A | 4/2000 | Liaom | |
| 6,715,710 | B1 | 4/2004 | Russell et al. | |
| 7,017,743 | B1 * | 3/2006 | Patterson | B65D 85/04 206/419 |
| 10,106,367 | B2 | 10/2018 | Nilsson | |
| 2004/0050996 | A1 | 3/2004 | Russell et al. | |
| 2005/0139723 | A1 | 6/2005 | Couchey et al. | |
| 2008/0283649 | A1 | 11/2008 | Anger et al. | |
| 2009/0314876 | A1 | 12/2009 | Kessler et al. | |
| 2011/0101153 | A1 | 5/2011 | Brennaman | |
| 2014/0056683 | A1 | 2/2014 | Niu | |
| 2014/0091170 | A1 * | 4/2014 | Gaudio | B65H 75/14 242/608.2 |
| 2015/0014471 | A1 * | 1/2015 | Omodei | B65H 75/4473 242/588 |
| 2016/0313526 | A1 | 10/2016 | Fordham et al. | |

OTHER PUBLICATIONS

PCT Notification of Transmittal of the International Preliminary Report on Patentability, mailed Aug. 12, 2021, in corresponding PCT Application No. PCT/US2020/015854.

"Notification of Transmittal of the International Search Report and the Written Opinion of the International Searching Authority, or the Declaration, in corresponding PCT Application No. PCT/US2020/015854 (May 27, 2020)".

* cited by examiner

DEVICES FOR CABLE MANAGEMENT

CROSS-REFERENCE TO RELATED APPLICATIONS

The present application is a divisional of and claims priority to U.S. patent application Ser. No. 16/777,311, filed Jan. 30, 2020, which claims priority from and the benefit of U.S. Provisional Application Ser. No. 62/800,011, filed Feb. 1, 2019, and U.S. Provisional Application Ser. No. 62/871,398, filed Jul. 8, 2019, the disclosures of which are hereby incorporated herein in their entirety.

FIELD

The present application is directed generally toward telecommunications equipment, and more particularly, cable reels for storing cables at a wireless installation site and cable reel covers for same.

BACKGROUND

Currently, excess cables used for telecommunications towers are being stored in sheet metal boxes at the installation site. These boxes are expensive, large and may require the customer to pay a monthly leasing fee per box. In addition, the use of metal components near an antenna on cell sites can be a source of unwanted passive intermodulation (PIM) in the modern radio frequency (RF) environment. There may be a need for smaller, light-weight, non-metallic alternatives for storing excess cables used in small cell telecommunications towers that reduce costs and allow for easy installation, while alleviating technical performance concerns, such as, PIM.

SUMMARY

A first aspect of the present invention is directed to a cable reel, comprising: a hollow core having a width; a first wall coupled to an end of the core and extending radially outward a distance from the core, the first wall comprising an opening aligned with the hollow core and at least one support member extending across the opening; and a second wall coupled to an opposing end of the core and extending radially outwardly a distance from the core, the second wall comprising an opening aligned with the hollow core; wherein the first wall and the second wall form a gap therebetween equal to the width of the core, the gap being configured to hold a length of excess cable wrapped around the core.

Another aspect of the present invention is directed to a cable reel, comprising: a hollow core having a width; a first wall coupled to an end of the core and extending radially outward a distance from the core, the first wall comprising an opening aligned with the hollow core and at least one support member extending across the opening; a second wall coupled to an opposing end of the core and extending radially outwardly a distance from the core, the second wall comprising an opening aligned with the hollow core, wherein the first wall and the second wall form a gap therebetween equal to the width of the core, the gap being configured to hold a length of excess cable wrapped around the core; and a plurality of removable extension flanges coupled to the first and second walls.

Another aspect of the present invention is directed to a cable reel, in combination with a discrete cable, comprising: a hollow core having a width; a first wall coupled to an end of the core and extending radially outward a distance from the core, the first wall comprising an opening aligned with the hollow core and at least one support member extending across the opening; and a second wall coupled to an opposing end of the core and extending radially outwardly a distance from the core, the second wall comprising an opening aligned with the hollow core, wherein the first wall and the second wall form a gap therebetween equal to the width of the core, the gap being configured to hold an excess length of the discrete cable wrapped around the core, and wherein the excess length of the discrete cable is wrapped around the core and held within the gap between the first and second walls.

Another aspect of the present invention is directed to a cable reel assembly, comprising: at least two cable reels, each cable reel comprising: a hollow core having a width; a first wall coupled to an end of the core and extending radially outward a distance from the core, the first wall comprising an opening aligned with the hollow core and at least one support member extending across the opening and at least two stacking tabs; and a second wall coupled to an opposing end of the core and extending radially outwardly a distance from the core, the second wall comprising an opening aligned with the hollow core and at least two stacking apertures, wherein the at least two stacking apertures are configured to receive the stacking tabs at least one of the cable reels; wherein the first wall and the second wall form a gap therebetween equal to the width of the core, the gap being configured to hold a length of excess cable wrapped around the core, wherein the at least two stacking tabs of one of the at least two cable reels are received by the at least two stacking apertures of another of the at least two cable reels such that the cable reels are in a secured and stacked relationship.

Another aspect of the present invention is directed to a cable reel assembly. The cable reel assembly may comprise a cable reel and a cable reel cover. The cable reel may comprise a hollow core having a width, a first wall coupled to an end of the core and extending radially outward a distance from the core, the first wall comprising an opening aligned with the hollow core and at least one support member extending across the opening, and a second wall coupled to an opposing end of the core and extending radially outwardly a distance from the core. The second wall may comprise an opening aligned with the hollow core, wherein the first wall and the second wall form a gap therebetween equal to the width of the core, the gap being configured to hold a length of excess cable wrapped around the core. The cable reel cover may comprise at least one wall and one or more support members extending radially inward from a top edge of the at least one wall, wherein the cable reel cover is configured to fit over the cable reel and cover the gap between the first wall and the second wall of the cable reel.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1A:
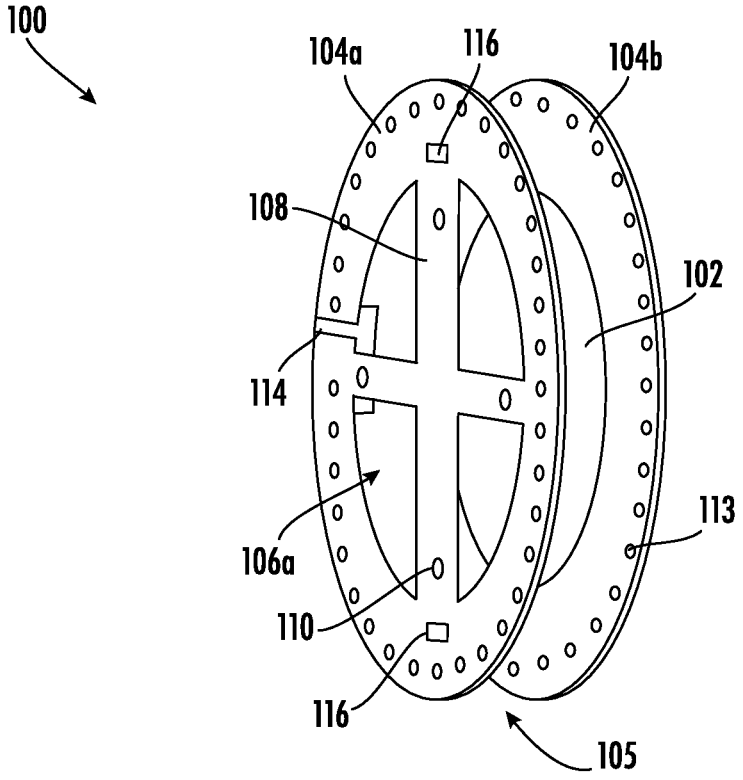
FIG. 1A is a top perspective view of a cable reel for trunk cables according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention now will be described more fully hereinafter with reference to the accompanying drawings, in which illustrative embodiments of the invention are shown. Like numbers refer to like elements throughout and different embodiments of like elements can be designated using a different number of superscript indicator apostrophes (e.g., 10', 10", 10''').

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Pursuant to embodiments of the present invention, cable reels and cable reel assemblies are provided that may allow for fiber cable management at installation sites for telecommunications equipment. Embodiments of the present invention will now be discussed in greater detail with reference to FIGS. 1A-14C.

Referring to FIGS. 1A-1D, a cable reel 100 according to embodiments of the present invention is illustrated. As shown in FIG. 1A-1D, the cable reel 100 comprises a hollow elliptical core 102 having width ($w_c$). In some embodiments, the core 102 may have a width ($w_c$) in the range of about 2 inches to about 4 inches. In some embodiments, the core 102 may have a length ($l_c$) in the range of about 11 inches to about 15 inches.

The cable reel 100 further comprises a first wall 104*a* and a second wall 104*b*, each wall 104*a*, 104*b* having a length ($l_w$) and a thickness (t). In some embodiments, each wall 104*a*, 104*b* may have a thickness (t) in the range of about 0.25 inches and 1.5 inches. Each wall 104*a*, 104*b* is coupled to or integral with an opposing end of the core 102 and extends radially outward a distance (d) from the core 102 (see, e.g., FIG. 1D). For example, in some embodiments, each wall 104*a*, 104*b* extend radially outward a distance (d) from the core 102 in the range of about 1 inch to about 2 inches. As such, the total length ($l_w$) of each wall 104*a*, 104*b* is equal to the sum of the length ($l_c$) of the core 102 and the extended distance (d) of the respective wall 104*a*, 104*b*. In some embodiments, each wall 104*a*, 104*b* may have a total length ($l_w$) in the range of about 13 inches to about 19 inches. In some embodiments, each wall 104*a*, 104*b* may have a height (h) in the range of about 12 inches to about 17 inches. In some embodiments, the first and second walls 104*a*, 104*b* have an elliptical shape.

Each wall 104*a*, 104*b* comprises an opening 106*a*, 106*b*. The center of each opening 106*a*, 106*b* is aligned with the center of the hollow core 102. Aligning the centers of the hollow core 102 and the openings 106*a*, 106*b* in each wall 104*a*, 104*b* allow for wind to flow through the cable reel 100 with the less restriction, thereby potentially reducing wind loading on the cable reel 100. This may be advantageous, for example, when the cable reel 100 is mounted on top of an antenna tower (see, e.g., FIG. 2A)

Figure 1B:
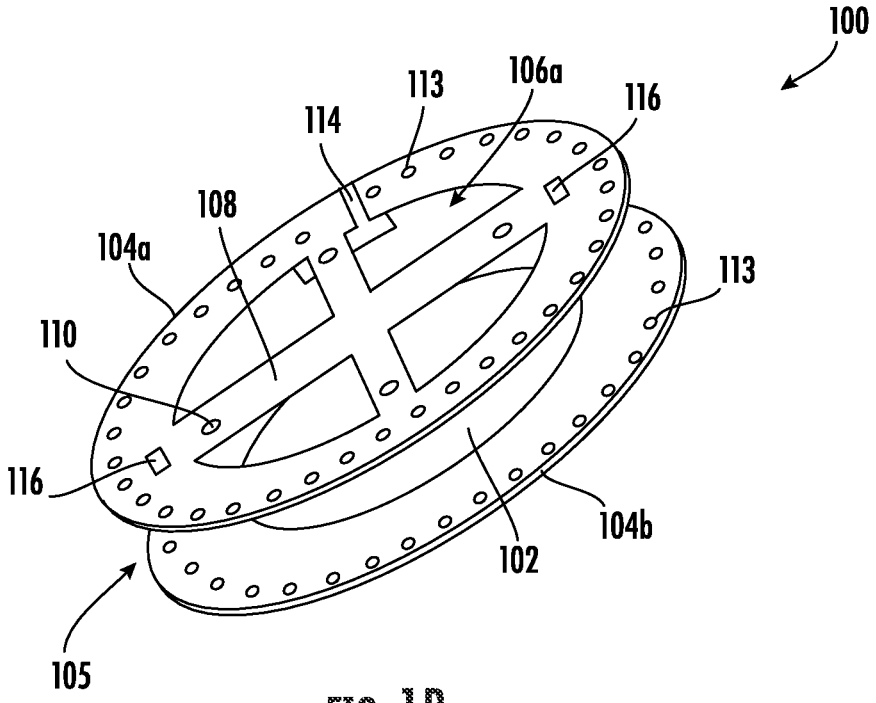
FIG. 1B is a side perspective view of the cable reel of FIG. 1A.

As shown in FIGS. 1A-1B, the first wall 104*a* and the second wall 104*b* form a gap 105 therebetween. The width of the gap 105 is equal to the width (w) of the core 102. For example, in some embodiments, the width (w) of the gap 105 is in the range of about 2 inches to about 4 inches. The gap 105 is configured to hold a length of excess cable 160 that may be wrapped around the core 102 (see, e.g., FIG. 3B). In some embodiments, the gap 105 is configured to hold a length of excess trunk cable. For example, in some embodiments, the gap 105 of cable reel 100 may hold 30 or more meters of excess cable 160 having a diameter of about 10 mm.

Figure 1C:
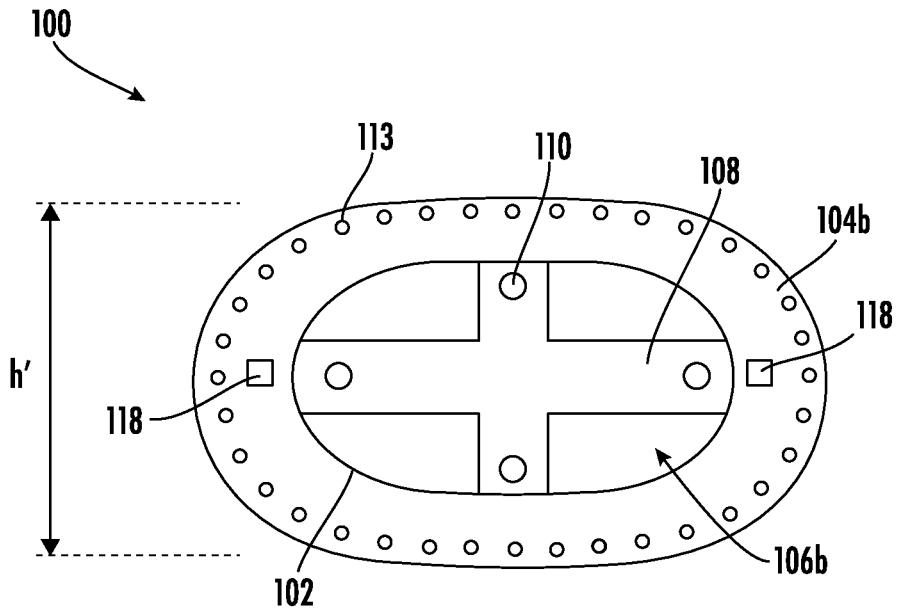
FIG. 1C is a side view of the cable reel of FIG. 1A.
Figure 1D:
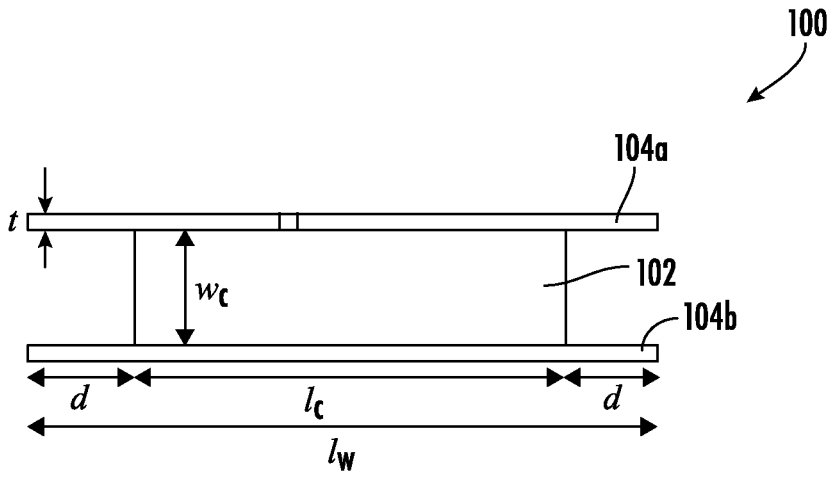
FIG. 1D is a top view of the cable reel of FIG. 1A.

In some embodiments, the first wall 104*a* may comprise one or more support members 108 extending across the opening 106*a*. For example, as shown in FIGS. 1A-1C, in some embodiments, the first wall 104*a* may comprise two support members 108 extending across the opening 106*a* of the first wall 104*a* and intersect in the center of the opening 106*a* of the first wall 104*a*. The support members 108 may provide structural support to the cable reel 100.

Figure 2A:
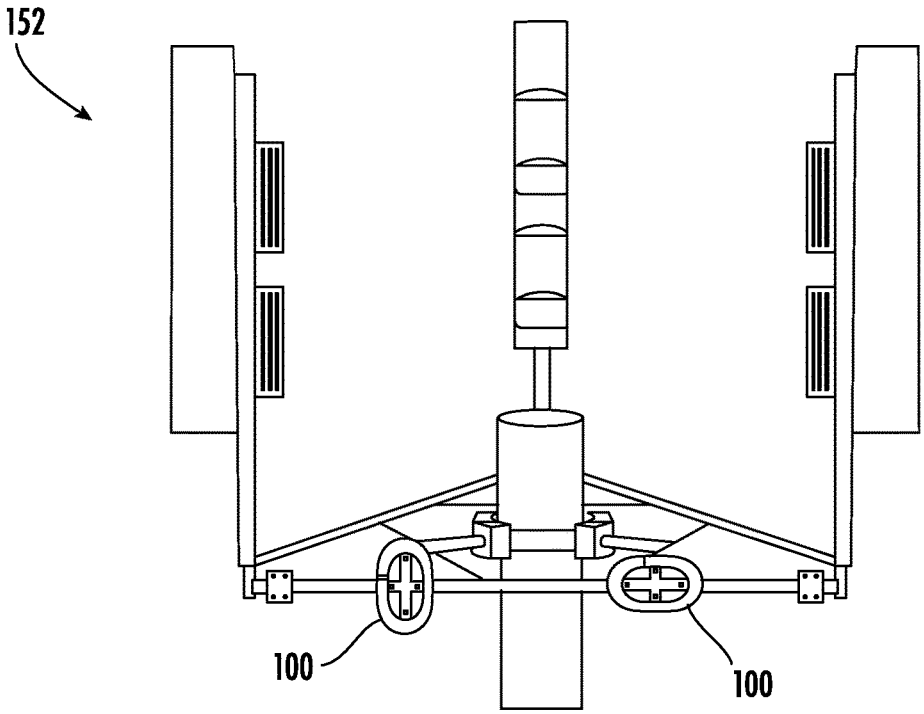
FIG. 2A is an illustration of multiple cable reels of FIG. 1A secured to an antenna according to embodiments of the present invention.
Figure 2B:
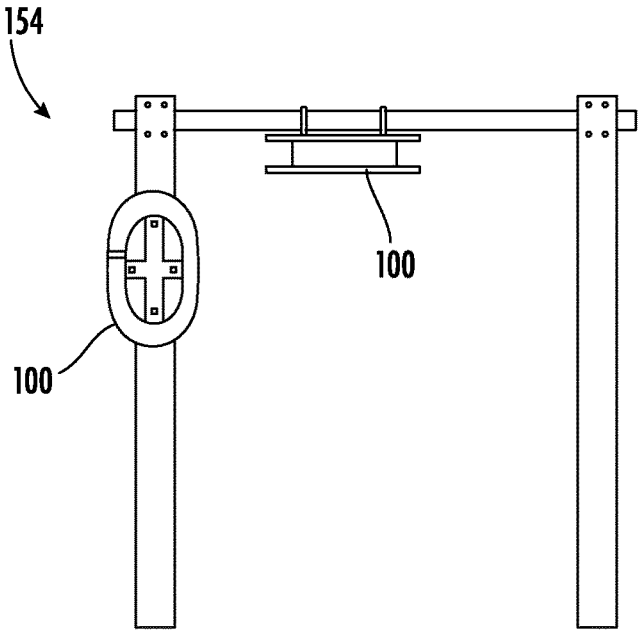
FIG. 2B is an illustration of multiple cable reels of FIG. 1A secured to a waveguide bridge according to embodiments of the present invention.
Figure 2C:
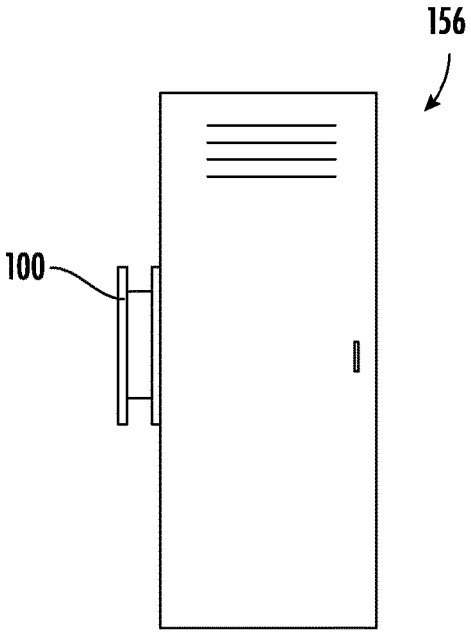
FIG. 2C is an illustration of the cable reel of FIG. 1A secured to a cabinet according to embodiments of the present invention.

In some embodiments, the first wall 104*a* of the cable reel 100 may further comprise a plurality of mounting apertures 110. The mounting apertures 110 may be located on the support members 108 (see, e.g., FIGS. 1A-1B). Each of the mounting apertures 110 may be configured to mount and secure the cable reel 100 to a mounting structure 150 (see, e.g., FIGS. 2A-2C). For example, the mounting apertures 110 may be configured to mount and secure the cable reel 100 to a variety of mounting structures 150 including, but not limited to, antenna towers, antenna tower accessories, and/or telecommunications equipment. FIGS. 2A-2C illustrate exemplary mounting structures 150 that the cable reel 100 of the present invention may be mounted, e.g., an antenna tower 152 (FIG. 2A), a waveguide bridge 154 (FIG. 2B), and/or a cabinet 156 (FIG. 2C).

Figure 3A:
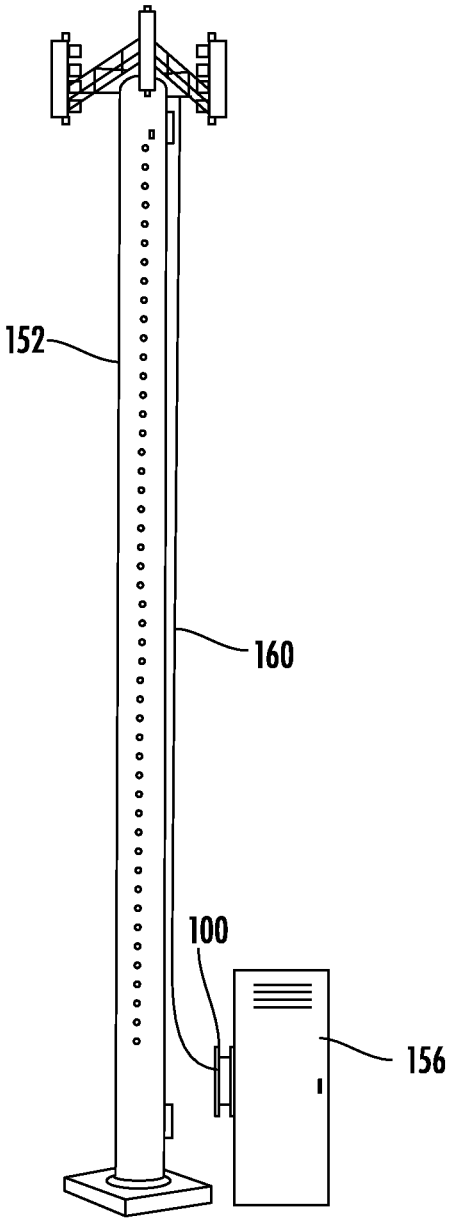
FIG. 3A is an illustration of an exemplary use of the cable reel of FIG. 1A according to embodiments of the present.
Figure 3B:
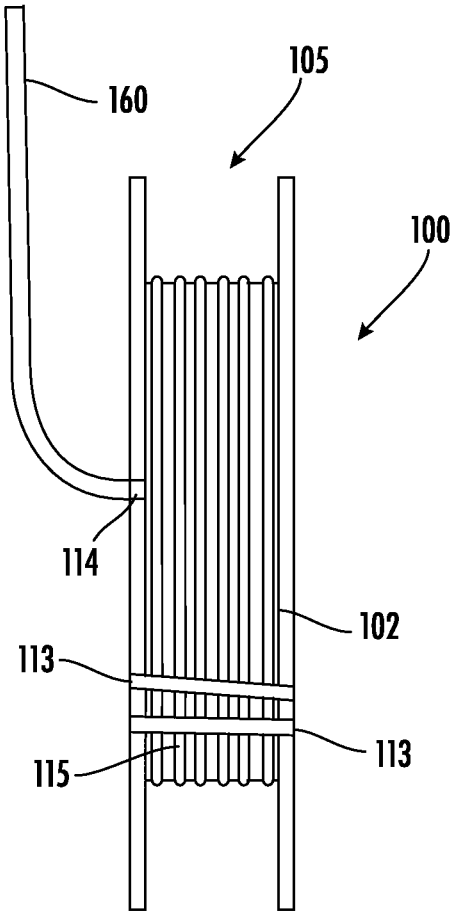
FIG. 3B is an enlarged view of the cable reel of FIG. 1A in combination with a trunk cable.

Still referring to FIGS. 1A-1B, in some embodiments, the first wall 104*a* of the cable reel 100 may further comprise a cable notch 114 (see also, e.g., FIGS. 3A-3B). The cable notch 114 may be configured to receive a trunk cable 160. For example, in some embodiments, the cable notch 114 may be configured to receive a cable having a diameter of about 10 mm. The cable notch 114 allows an excess length of cable 160 to be received by the cable reel 100 and wrapped around the core 102 (see, e.g., FIG. 3B). The cable notch 114 may also help to prevent a cable 160 already wrapped around the core 102 from unraveling from the cable reel 100.

Figure 5:
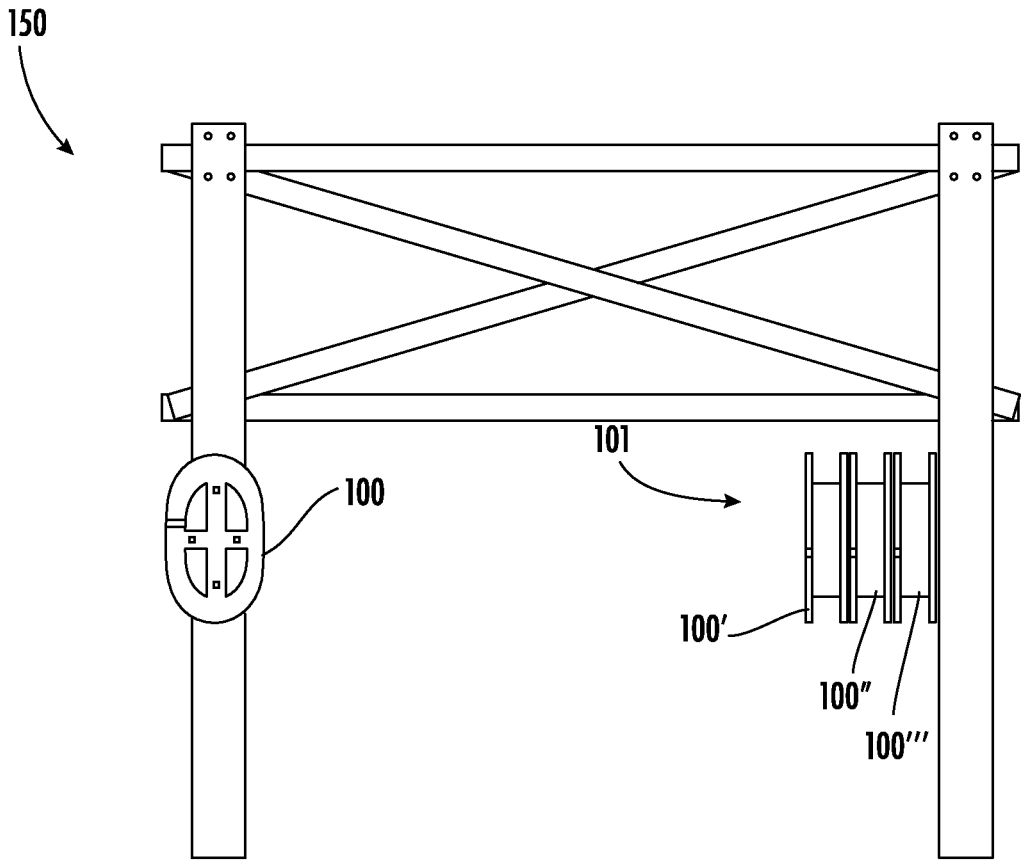
FIG. 5 is an illustration of multiple cable reels stacked together and secured to the base of an antenna tower according to embodiments of the present invention.

As shown in FIGS. 1A-1C, in some embodiments, the first wall 104*a* of the cable reel 100 may comprise at least two stacking tabs (or latches) 116 and the second wall 104*b* of the cable reel 100 may comprise at least two stacking apertures 118. The stacking apertures 118 may be configured to receive and secure the stacking tabs 116 of a second cable reel 100, thereby allowing multiple cable reels 100 of the present invention to be stacked together. For example, FIG. 5 illustrates three cable reels 100', 100", 100'" that are stacked together while mounted to the base of an antenna tower. Other structures may be used to stack the cable reels 100', 100", 100'" together, such as, for example, latches, posts, holes, etc.

Still referring to FIGS. 1A-1C, in some embodiments, the first and second walls 104*a*, 104*b* may further comprise a plurality of lacing apertures 113. When a cable 160 is wrapped around the core 102 of the cable reel 100, one or more lacing members 115 may be used to help prevent the cable 160 from unraveling from the cable reel 100 (see, e.g., FIG. 3B). As shown in FIG. 3B, a lacing member 115 may be laced across the gap 105 of the cable reel 100 and through two or more of the lacing apertures 113 to help retain the wrapped cable 160 secured around the cable reel 100. The lacing member 115 may also be used when the cable reel 100 is being transported and/or after the cable reel 100 has been installed at an antenna site. A variety of known items may be used for the lacing member 115, such as, for example, ropes, cables, zip-ties, strings, cords, or the like.

FIGS. 3A and 3B illustrate an exemplary use of the cable reel 100 according to embodiments of the present invention. As shown in FIG. 3A, a cable 160 (e.g., a trunk cable) is routed from the top of an antenna tower 152 to a cabinet 156 located adjacent the base of the antenna tower 152 where a cable reel 100 of the present invention is mounted to the cabinet 156. The excess cable 160 is able to be stored by wrapping the excess cable 160 around the cable reel 100. Thus, the cable reel 100 of the present invention may provide an inexpensive and easy way to store excess cable 160 near the antenna tower 152.

FIG. 3B is an enlarged view of the cable reel 100 having excess cable 160 wrapped around the core 102 and within the gap 105 of the cable reel 100. The cable notch 114 allows the cable 160 to easily exit the cable reel 100 and extend up the antenna tower 152. A lacing member 115 is laced across the gap 105 of the cable reel 100 and through two or more of the lacing apertures 113, thereby helping to secure the wrapped cable 160 around the cable reel 100.

Figure 4A:
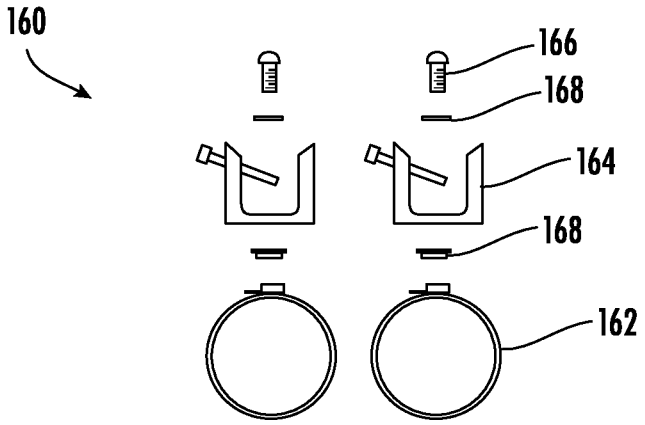
FIG. 4A is an illustration of an exemplary mounting kit used with the cable reel of FIG. 1A according to embodiments of the present invention.
Figure 4B:
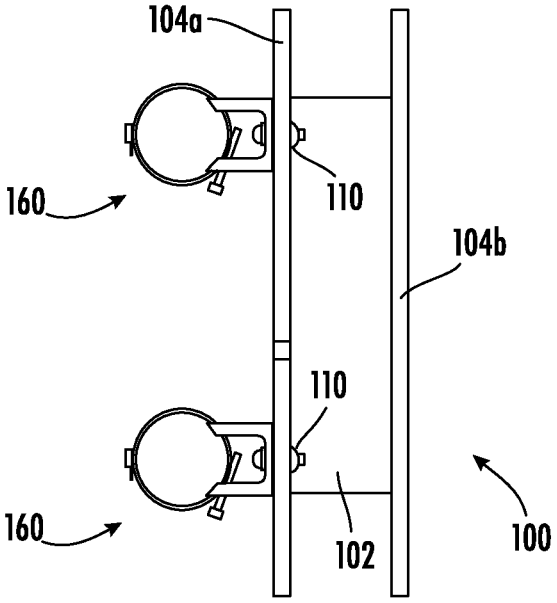
FIG. 4B is a top view of the mounting kit in combination with the cable reel of FIG. 1A according to embodiments of the present invention.
Figure 4C:
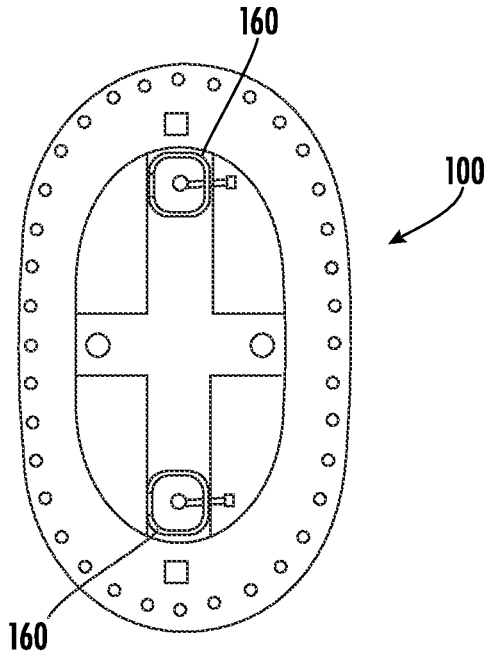
FIG. 4C is a side view of the mounting kit and cable reel shown in FIG. 4B.

Referring now to FIGS. 4A-4C, an exemplary mounting kit 160 that may be used to mount the cable reel 100 of the present invention to a mounting structure 150 is illustrated. It is noted that various types of mounting kits 160 may be used to mount the cable reel 100 of the present invention to a mounting structure 150. For example, as shown in FIG. 4A, the mounting kit 160 may include clamps 162, brackets 164, bolts 166 and/or washers 168.

FIG. 4B is a side view of the mounting kit 160 in combination with the cable reel 100 according to embodiments of the present invention. As shown in FIG. 4B, the mounting kit 160 may be attached to the cable reel 100 utilizing one or more of the mounting apertures 110 in the first wall 104*a* of the cable reel 100. FIG. 4C is a top view of the mounting kit 160 attached to the cable reel 100 according to embodiments of the present invention.

Referring now to FIG. 5, and as discussed above, a cable reel assembly 101 according to embodiments of the present invention is illustrated. As shown, two or more cable reels 100 of the present invention may be stacked together, thereby allowing for additional excess cable 160 to be stored at or near the mounting structure 150. For example, as shown in FIG. 5, three cable reels 100', 100", 100'" may be stacked together and mounted to the base of an antenna tower. When stacked together, the cable notch 114 of each cable reel 100 allows for the wrapped cables 160 to be easily routed from the cable reels 100 to different antennas.

Referring to FIGS. 6A-6D, a cable reel 200 according to embodiments of the present invention is illustrated. The cable reel 200 is similar to the cable reel 100 discussed above except on a smaller scale and may be used to store smaller diameter cables 160. In some embodiments, the gap 205 may be configured to hold a length of excess jumper cable. For example, in some embodiments, the gap 205 of cable reel 200 may hold 10 or more meters of excess cable 160 having a diameter of about 6 mm.

In some embodiments, the core 202 of the cable reel 200 may have a width (w') in the range of about 1.5 inches to about 2 inches. In some embodiments, the core 202 may have a length ($l_c$') in the range of about 6 inches to about 8 inches. In some embodiments, each wall 204*a*, 204*b* of the cable reel 200 may have a thickness (t') in the range of about 0.25 inches and 0.75 inches. In some embodiments, each wall 204*a*, 204*b* of the cable reel 200 may extend radially outward a distance (d') from the core 202 in the range of about 0.5 inches to about 1.5 inches. In some embodiments, each wall 204*a*, 204*b* of the cable reel 200 may have a total length ($l_w$') in the range of about 7 inches to about 11 inches. In some embodiments, each wall 204*a*, 204*b* may have a height (h') in the range of about 3 inches to about 6 inches.

Figure 6A:
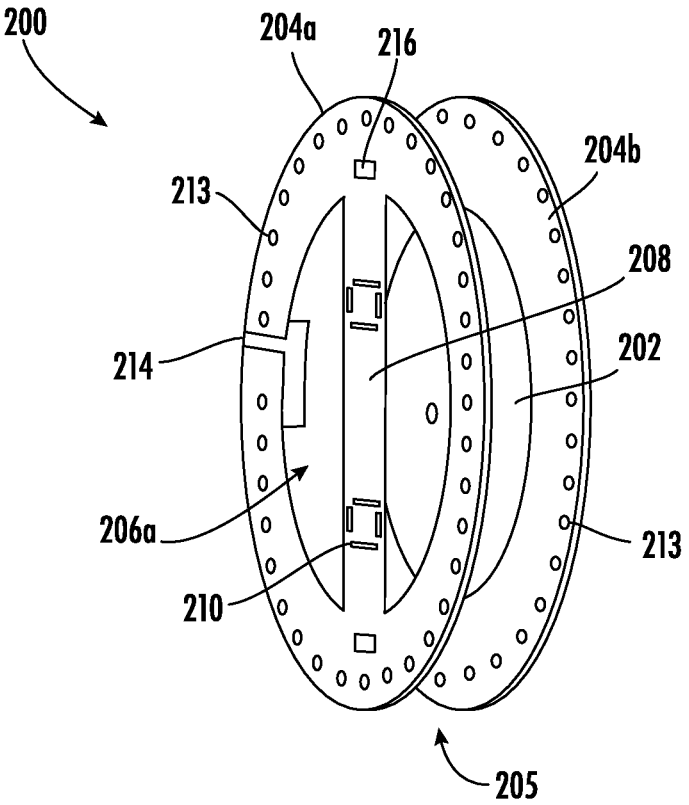
FIG. 6A is a top perspective view of a cable reel for jumper cables according to embodiments of the present invention.
Figure 6B:
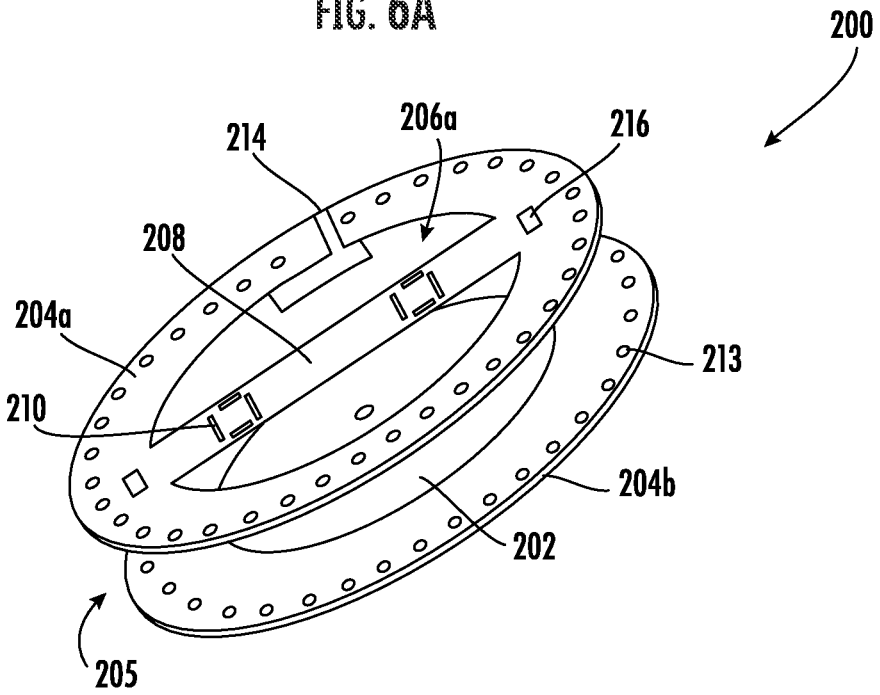
FIG. 6B is a side perspective view of the cable reel of FIG. 6A.
Figure 6C:
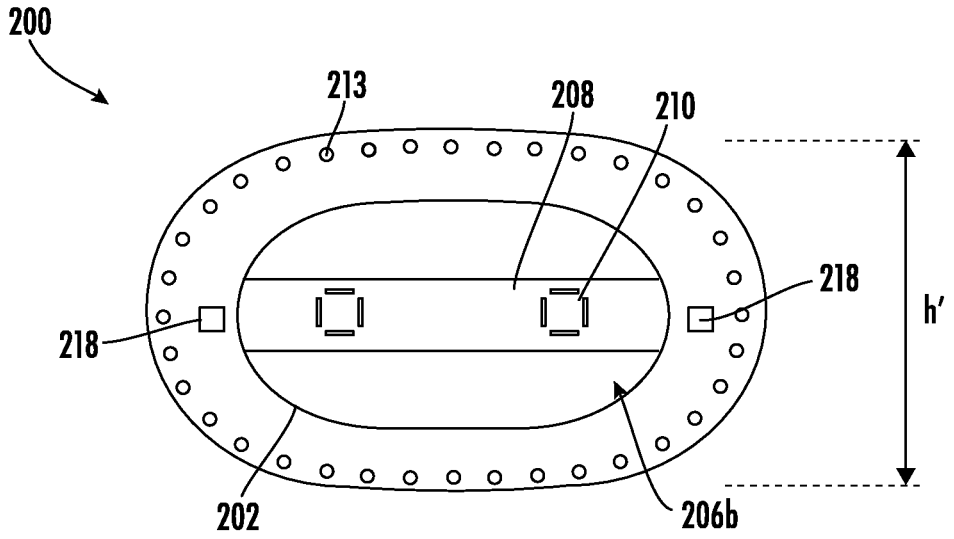
FIG. 6C is a side view of the cable reel of FIG. 6A.
Figure 6D:
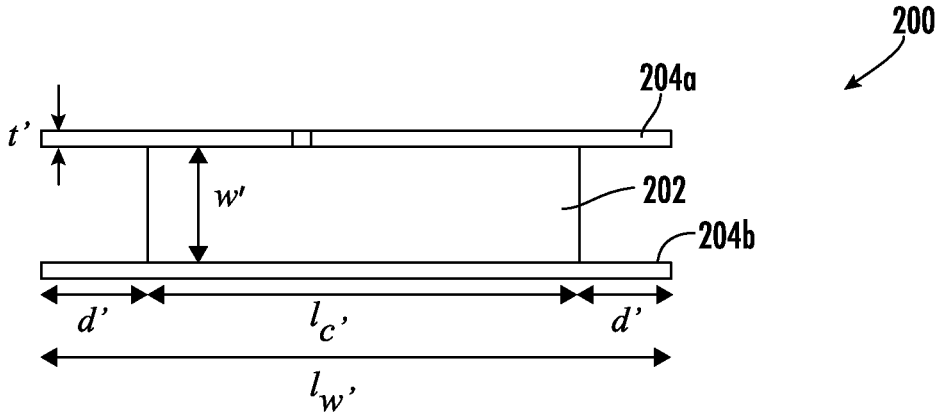
FIG. 6D is a top view of the cable reel of FIG. 6A.
Figure 7:
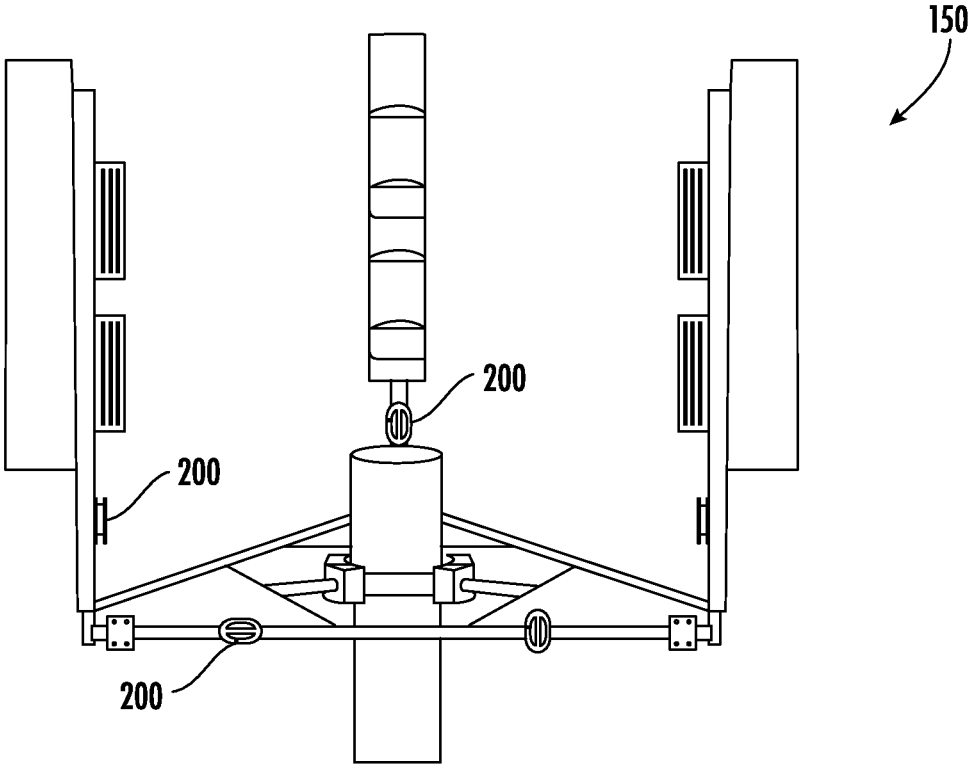
FIG. 7 is an illustration of multiple cable reels of FIG. 1A secured to an antenna according to embodiments of the present invention.

Still referring to FIGS. 6A-6C, in some embodiments, the first wall 204*a* may comprise one support member 208 extending across an opening 206*a*. In some embodiments, the first wall 204*a* of cable reel 200 may comprise have a plurality of mounting notches 210 which are similar to the mounting apertures 110 of cable reel 100 discussed above. The mounting notches 210 may be located on the support member 208. Each of the mounting notches 210 may be configured to mount and secure the cable reel 200 to a mounting structure 150, for example, the top of an antenna tower (see, e.g., FIG. 7). Similar to the cable reel 100 discussed above, cable reel 200 may comprise a cable notch 214. The cable notch 214 may be configured to receive a jumper cable 160. For example, in some embodiments, the cable notch 214 may be configured to receive a cable having a diameter of about 6 mm.

Figure 8A:
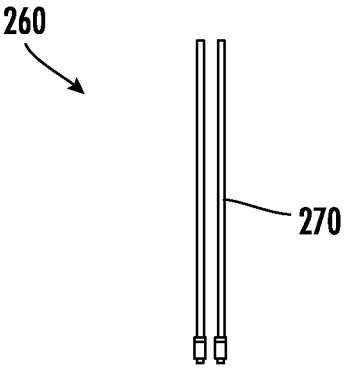
FIG. 8A is an illustration of an exemplary mounting kit used with the cable reel of FIG. 6A according to embodiments of the present invention.
Figure 8B:
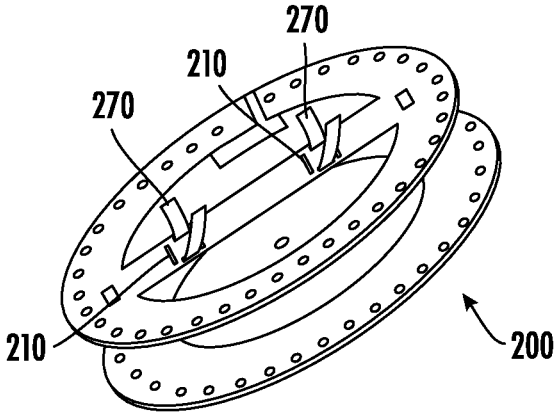
FIG. 8B a side perspective view of the mounting kit in combination with the cable reel of FIG. 6A according to embodiments of the present invention.

Referring now to FIG. 8A and FIG. 8B an exemplary mounting kit 260 that may be used to mount the cable reel 200 of the present invention to a mounting structure 150 is illustrated. It is noted that various types of mounting kits 260 may be used to mount the cable reel 200 of the present invention to a mounting structure 150. For example, as shown in FIG. 8A, the mounting kit 260 may simply include a pair of cables or zip-ties 270. FIG. 8B is a side perspective view of the mounting kit 260 in combination with the cable reel 200 according to embodiments of the present invention. As shown in FIG. 8B, the mounting kit 260 (e.g., zip-ties 270) may be attached to the cable reel 200 utilizing one or more of the mounting notches 210 in the first wall 204*a* of the cable reel 200.

Figure 9A:
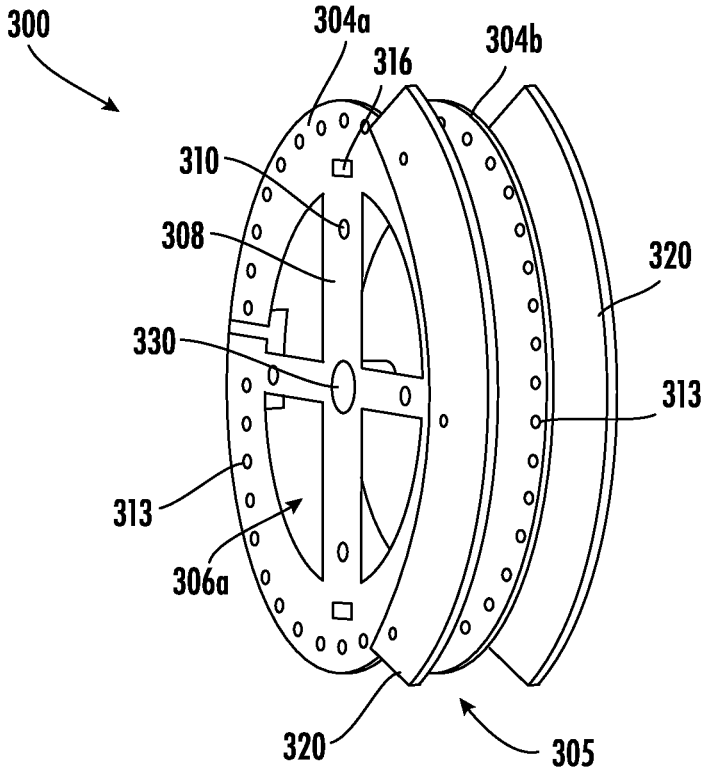
FIG. 9A a top perspective view of a cable reel for shipping and storing trunk cables according to embodiments of the present invention.

Referring now to FIGS. 9A-9E, a cable reel 300 adapted for shipping and storing trunk cables according to embodiments of the present invention is illustrated. As shown in FIG. 9A, the cable reel 300 is similar to the cable reel 100 discussed above, except cable reel 300 has some additional features. For example, in some embodiments, the cable reel 300 may comprise a plurality of extension flanges 320. In some embodiments, the cable reel 300 may comprise four extension flanges 320.

Figure 9B:
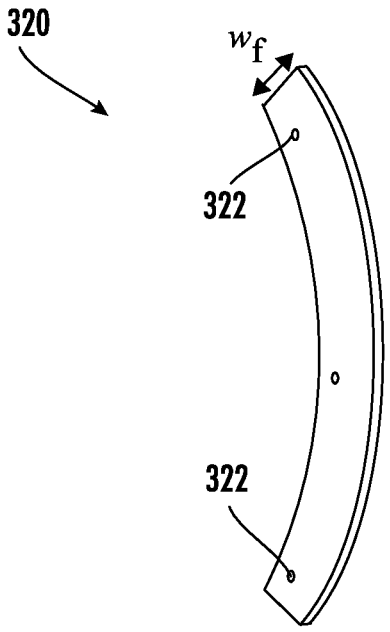
FIG. 9B is a side view of a flange extender for the cable reel of FIG. 9A.
Figure 9C:
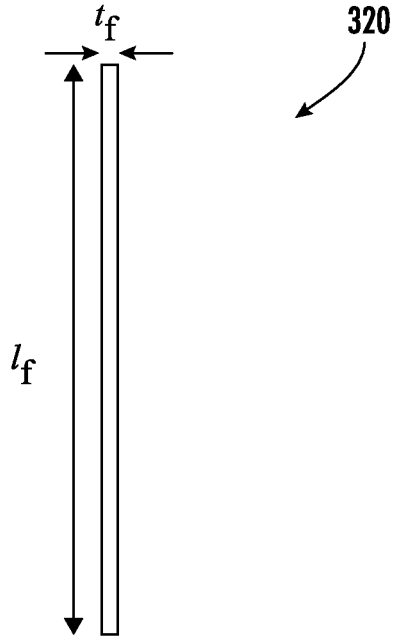
FIG. 9C is a front view of the flange extender of FIG. 9B.

As shown in FIGS. 9B-9C, each extension flange 320 has a length ($l_f$), a width ($w_f$) and a thickness ($t_f$). In some embodiments, each extension flange 320 may have a length ($l_f$) in the range of about 14 inches to about 16 inches, a width ($w_f$) in the range of about 6 inches to about 8 inches, and a thickness ($t_f$) in the range of about 0.25 inches to about 0.75 inches.

The plurality of extension flanges 320 may be removably attached to the first and second walls 304*a*, 304*b* of the cable reel 300. Each extension flange 320 comprises a plurality of attachment apertures 322. The attachment apertures 322 are configured to align with the lacing apertures 313 in the first and second walls 304*a*, 304*b*. As shown in FIG. 9B, each extension flange 320 has an arcuate shape which mirrors the curvature of the walls 304*a*, 304*b* of the cable reel 300. This allows the attachment apertures 322 to properly align with the lacing apertures 313. To attach the extension flanges 320 to the cable reel 330, bolts or screws may be inserted through the attachment apertures 322 and lacing apertures 313.

When added to the cable reel 300, the extension flanges 320 increase the radial distance (d) that the first and second walls 304*a*, 304*b* extend from the core 302 of the cable reel 300. Increasing the radial distance (d) allows the cable reel 300 to hold a greater length of cable 160. For example, a cable reel 300 with the extension flanges 320 may hold about 100 or more meters of a cable 160 having a diameter of 10 mm. In some embodiments, the cable reel 300 may be used to ship and/or store trunk cables.

Figure 9D:
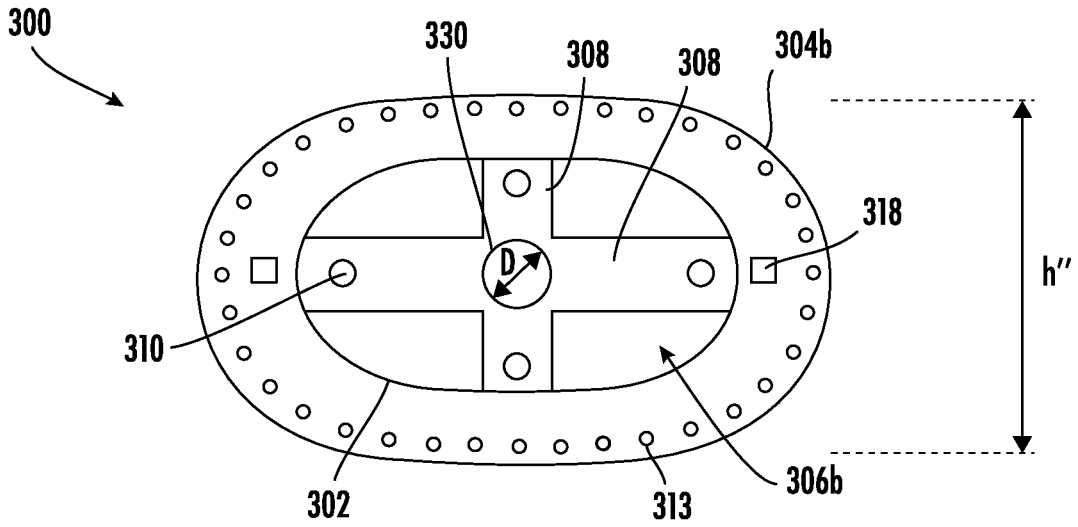
FIG. 9D is a side view of the cable reel of FIG. 9A.
Figure 9E:
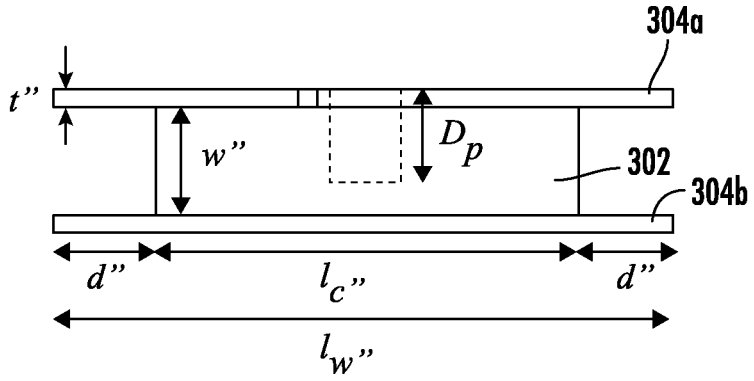
FIG. 9E is a top view of the cable reel of FIG. 9A.

In some embodiments, the cable reel 300 may have the similar dimensions to the cable reel 100 discussed above. In some embodiments, as shown in FIGS. 9A, 9D, and 9E, the first wall 304*a* of the cable reel 300 may further comprise a cavity 330. The cavity 330 has a diameter (D) and a depth (Dp). In some embodiments, the cavity 330 has a diameter (D) in the range of about 2 inches to about 4 inches. In some embodiments, the cavity has a depth (Dp) in the range of about 2 inches to about 4 inches.

The cavity 330 is located in the center of the first wall 304*a* at the intersection of the support members 308. The cavity 330 may be configured to receive a pole or a rod. During installation of a cable 160 that has been stored on the cable reel 300, an installer may insert a pole into the cavity 330 such that the cable reel 300 may rotate around the pole. The rotation of the cable reel 300 around the pole allows the installer to easily unwrap the cable 160 from the cable reel 300.

In some embodiments, the cable reels 100, 200, 300 of the present invention may be formed of a non-metallic material. For example, in some embodiments, the cable reels 100, 200, 300 of the present invention may comprise glass, nylon, acetal, polypropylene, and/or polyethylene.

Figure 10A:
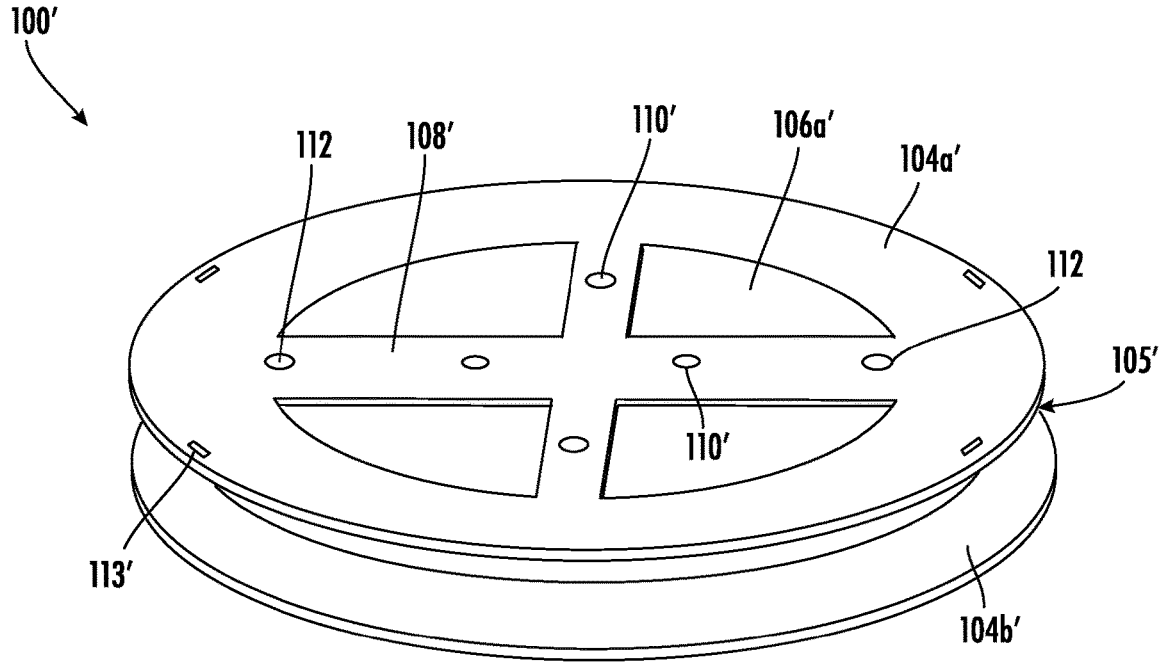
FIG. 10A is perspective view of a cable reel according to embodiments of the present invention.
Figure 10B:
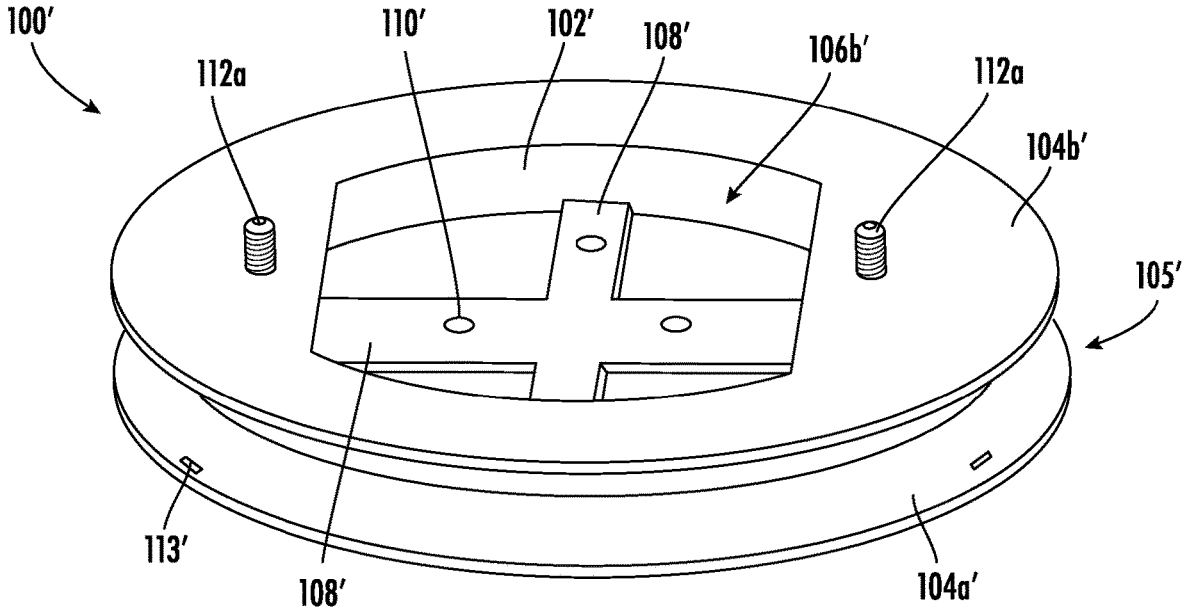
FIG. 10B is a perspective view of the cable reel of FIG. 10A.
Figure 11A:
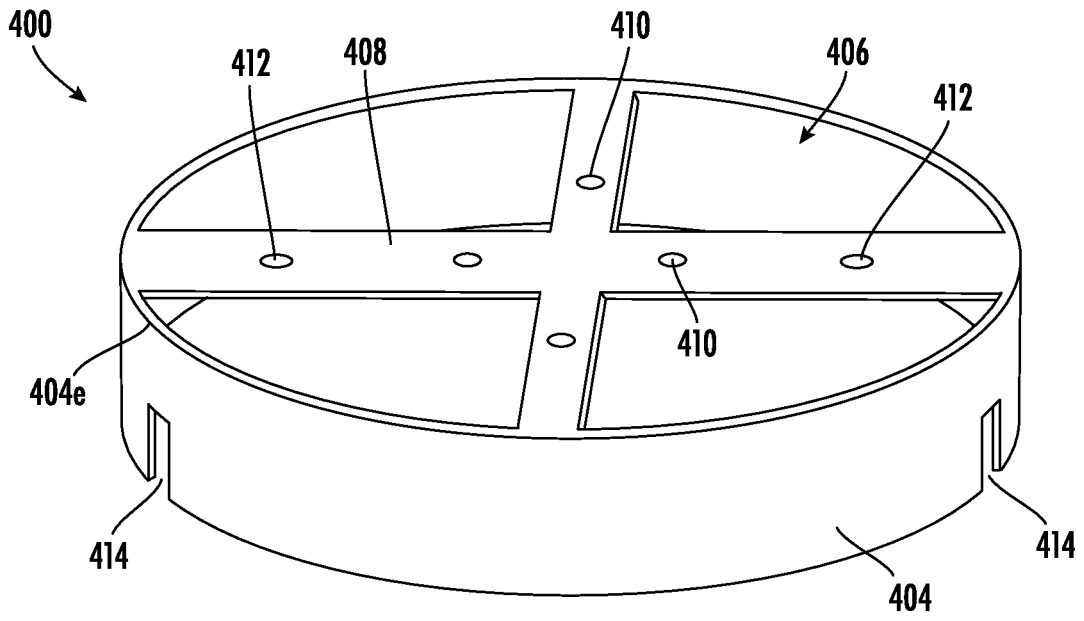
FIG. 11A is a perspective view of a cable reel cover according to embodiments of the present invention.
Figure 11B:
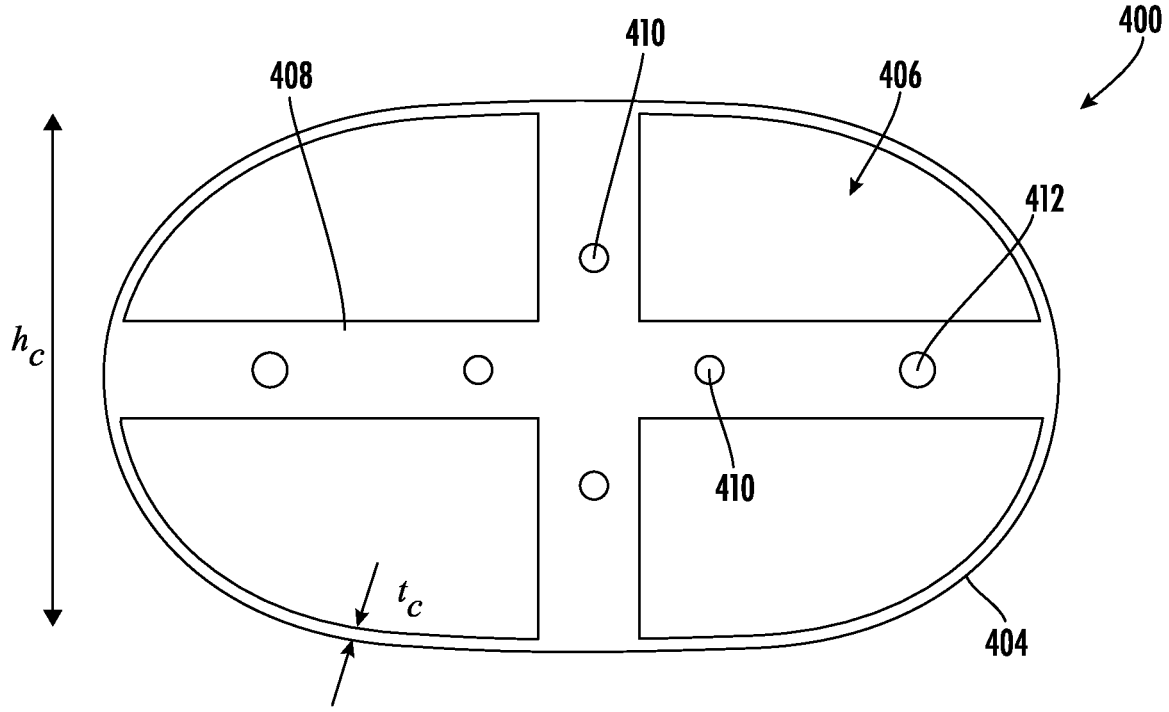
FIG. 11B is a top view of the cable reel cover of FIG. 11A.
Figure 11C:
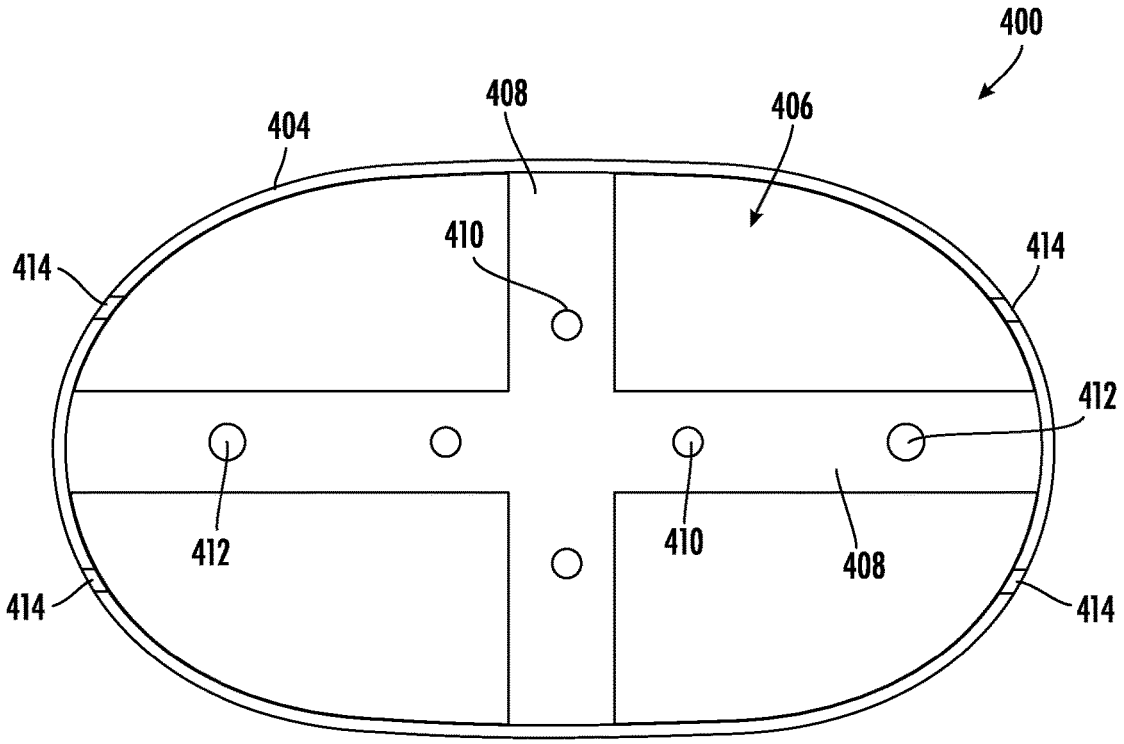
FIG. 11C is a bottom view of the cable reel cover of FIG. 11A.
Figure 11D:
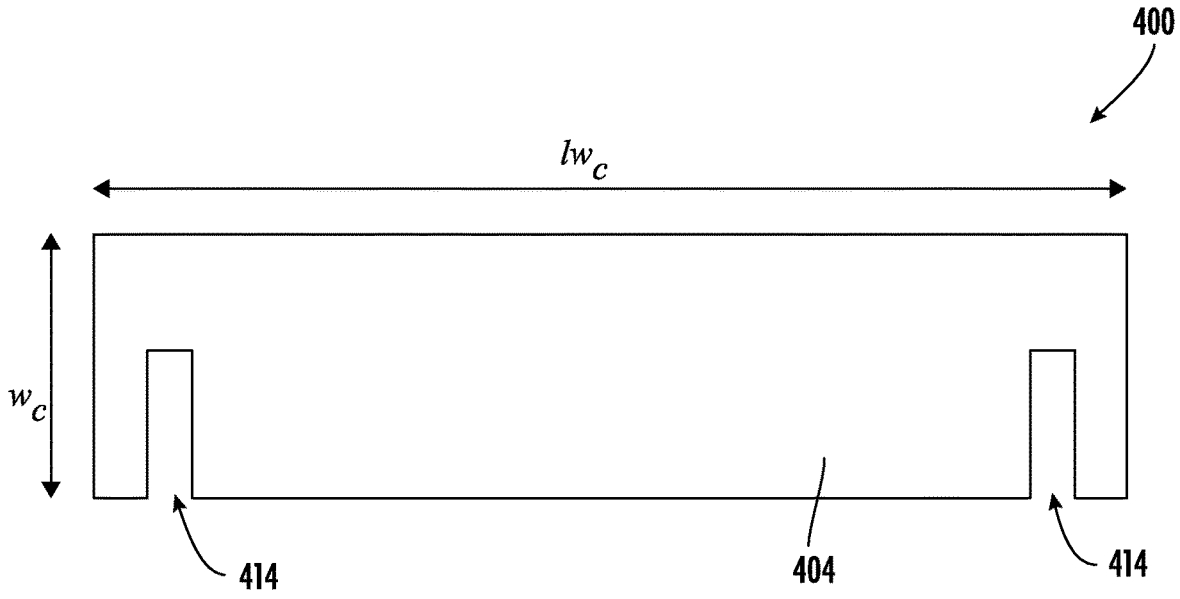
FIG. 11D is a side view of the cable reel cover of FIG. 11A.
Figure 12A:
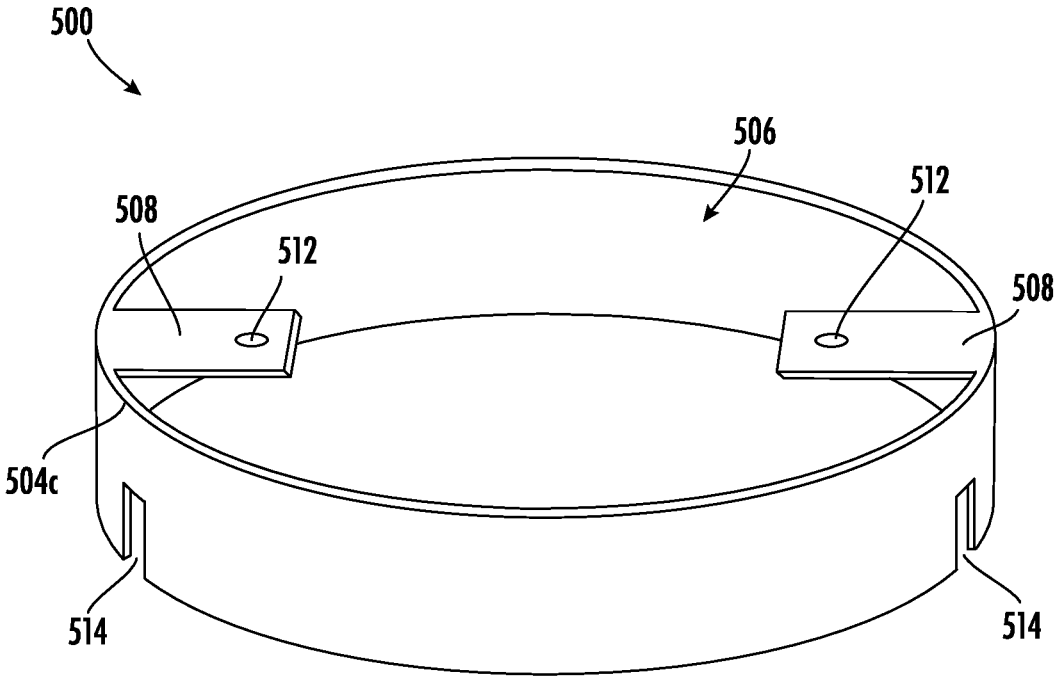
FIG. 12A is a perspective view of a cable reel cover according to embodiments of the present invention.
Figure 12B:
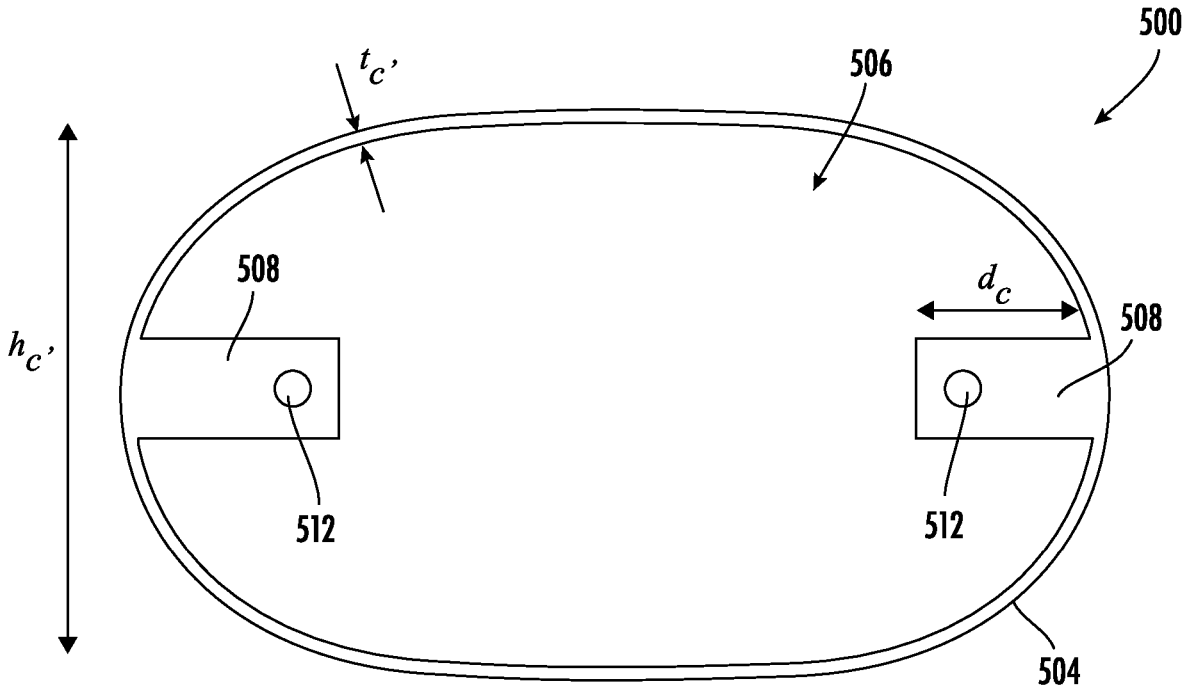
FIG. 12B is a top view of the cable reel cover of FIG. 12A.
Figure 12C:
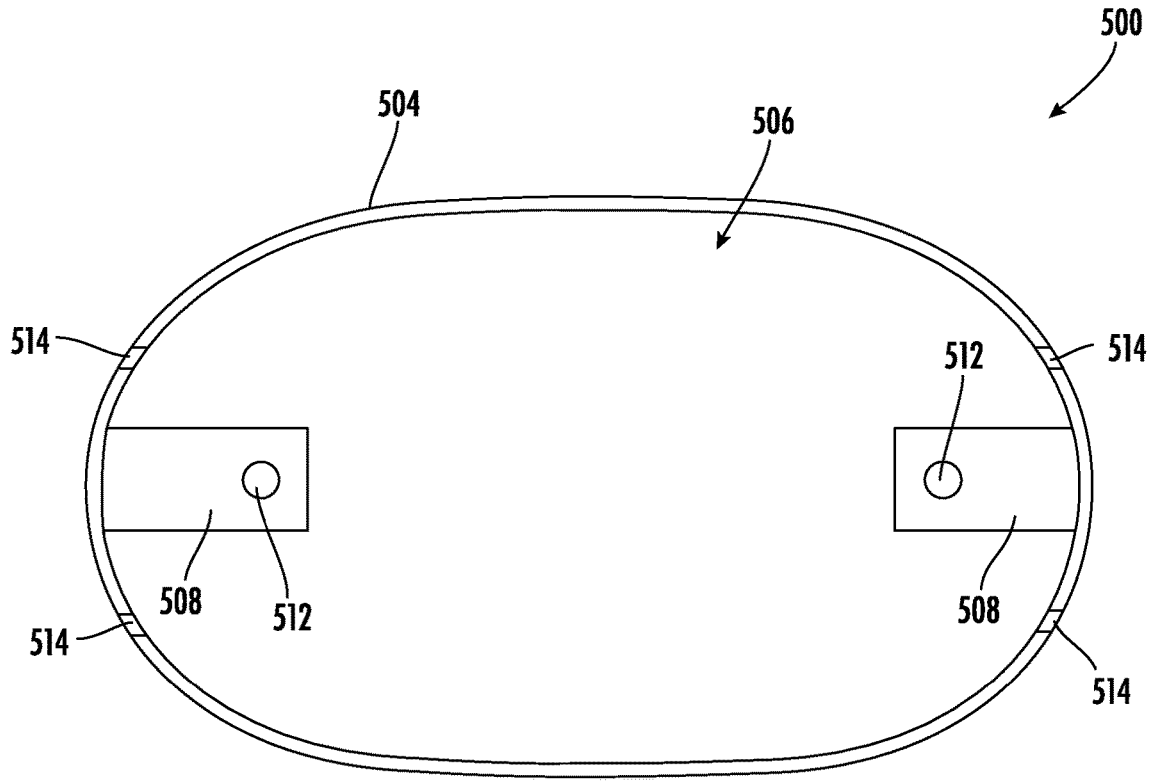
FIG. 12C is a bottom view of the cable reel cover of FIG. 12A.
Figure 12D:
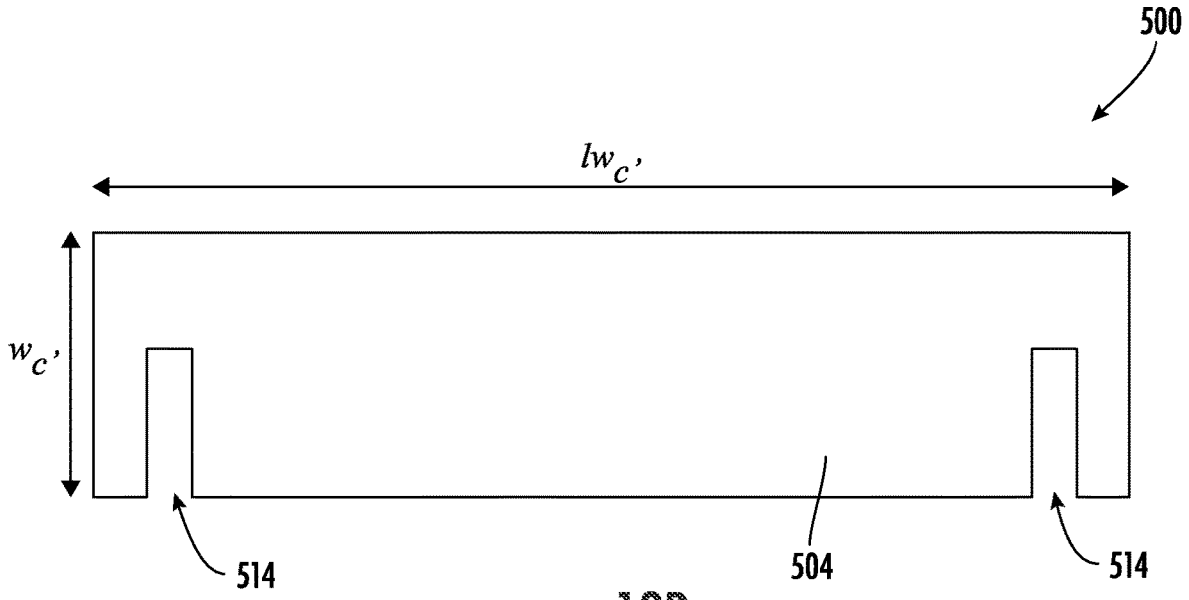
FIG. 12D is a side view of the cable reel cover of FIG. 12A.

Referring now to FIGS. 10A and 10B, another cable reel 100' according to embodiments of the present invention is illustrated. Cable reel 100' is similar to the cable reels 100, 200, 300 discussed above. As shown in FIGS. 10A and 10B, in some embodiments, the cable reel 100' may further comprise a plurality of alignment apertures 112 and/or alignment posts 112*a*. For example, alignment apertures 112 may be located in at least one of the support members 108'. The alignment posts 112*a* may extend outwardly from one of the walls 104*b'* of the cable reel cover 100'. In some embodiments, the alignment posts 112*a* may be a threaded rod. In some embodiments, the alignment apertures 112 are configured to receive alignment posts 112*a* from another cable reel 100', for example, when multiple cable reels 100' are stacked and mounted together (see, e.g., FIG. 5). As discussed in further detail below, in some embodiments, the alignment posts 112*a* may help to align and secure a cable reel cover 400, 500 on the cable reel 100' (see, e.g., FIGS. 13A-13B).

Referring now to FIGS. 11A-11D, a cable reel cover 400 according to embodiments of the present invention is illustrated. The cable reel cover 400 is configured to fit over the cable reels 100, 100', 200, 300 described above. The cable reel cover 400 may help to protect a cable 160 wrapped around the core 102 of the cable reel 100, 100', 200, 300 from environmental conditions, such as, rain, snow, etc. when the cable reel 100, 100', 200, 300 is mounted to a mounting structure 150. The cover 400 may also help to protect cables 160 during shipment and/or storage of the cable reel 100, 100', 200, 300.

As shown in FIGS. 11A-11D, the cable reel cover 400 of the present invention comprises at least one wall 404. The at least one wall 404 has a length ($lw_c$), a width ($w_c$), and a thickness ($t_c$) (see, e.g., FIGS. 11B and 11D). The cable reel cover 400 has a length ($lw_c$) and height ($h_c$) that are sufficient to fit over the length ($l_w$, $l_w'$, $l_w''$) and height (h, h', h'') of a cable reel 100, 100', 200, 300. The cover 400 also has a width ($w_c$) that is sufficient to fit over the gap 105, 105', 205, 305 of the cable reel 100, 100', 200, 300 such that when the cover 400 is placed over the cable reel 100, 100', 200, 300, the at least one wall 404 covers, and thereby protects, a cable 160 wrapped around the core 102, 102', 202, 302 (i.e., within the gap 105, 105', 205, 305) of the cable reel 100, 100', 200, 300. In some embodiments, the at least one wall 404 may have an elliptical shape similar to the cable reel 100, 100', 200, 300.

In some embodiments, the cover 400 may have a length ($lw_c$) in the range of about 13 inches to about 19 inches. In some embodiments, the cover 400 may have a height ($h_c$) in the range of about 12 inches to about 17 inches. In some embodiments, the width ($w_c$) of the cover 400 may be in the range of about 2 inches to about 4 inches. In some embodiments, the at least one wall 404 of the cover 400 may have a thickness ($t_c$) in the range of about 0.25 inches and 1.5 inches.

Still referring to FIGS. 11A-11D, in some embodiments, the at least one wall 404 of the cover 400 may comprise one or more support members 408 extending across an opening 406. The one or more support members 408 may be integral with the at least one wall 404 and extend radially inward from a top edge 404*e* of the at least one wall 404. For example, as shown in FIGS. 11A-11D, in some embodiments, the at least one wall 404 may comprise two support members 408 extending across the opening 406 of the at least one wall 404 and intersect in the center of the opening 406. The support members 408 may provide structural support to the cable reel cover 400. In some embodiments, the one or more support members 408 are configured to align with the support members 108, 108', 208, 308 of the cable reel 100, 100', 200, 300 when the cover 400 is placed on top of the cable reel 100, 200, 300.

In some embodiments, the at least one wall 404 of the cable reel cover 400 may further comprise a plurality of mounting apertures 410. The mounting apertures 410 may be located on one or more of the support members 408. Each of the mounting apertures 410 may align with mounting apertures 110, 110', 210, 310 of the cable reels 100, 100', 200, 300 such that the cable reel cover 400 may be mounted to a mounting structure 150 along with cable reel 100, 100', 200, 300.

In some embodiments, the at least one wall 404 of the cable reel cover 400 may further comprise a plurality of alignment apertures 412. The alignment apertures 412 may also be located on the support members 408. The alignment apertures 412 may help to align the cover 400 on the cable reel 100, 100', 200, 300. In some embodiments, the alignment apertures 412 may be configured to receive alignment posts 112*a* from the cable reel 100' to secure the cable reel cover 400 to the cable reel 100' (see, e.g., FIGS. 13A-13B).

Still referring to FIGS. 11A-11D, in some embodiments, the at least one wall 404 may comprise a plurality of cable notches 414. For example, in some embodiments, the at least one wall 404 may comprise two or four cable notches 414. Similar to the cable notches 114, 214 described above with respect to the cable reels 100, 200, the cable notches 414 may be configured to receive a jumper and/or trunk cable 160. For example, in some embodiments, the cable notches 414 may be configured to receive a cable 160 having a diameter of about 6 mm to about 10 mm. The cable notches 414 provide entry and exit points for a jumper or trunk cable 160 that is wrapped around the core 102 of a cable reel 100 (see, e.g., FIG. 3B).

Referring now to FIGS. 12A-12D, another cable reel cover 500 according to embodiments of the present invention is illustrated. Cable reel cover 500 is similar to cable reel cover 400 in that the cable reel cover 500 is configured to fit over the cable reels 100, 100', 200, 300 described above and helps to protect a cable 160 wrapped around the core 102 of the cable reel 100, 100', 200, 300 from environmental conditions, such as, rain, snow, etc. when the cable reel 100, 100', 200, 300 is mounted to a mounting structure 150, as well as help to protect cables 160 during shipment and/or storage of the cable reel 100, 100', 200, 300.

As shown in FIGS. 12A-12D, in some embodiments, a difference between cable reel cover 500 and cable reel cover 400 is that the one or more support members 508 do not extend completely across the opening 506 of the at least one wall 504, and therefore may not intersect in the center of the opening 506. For example, in some embodiments, each of the one or more support members 508 of cable reel cover 500 may extend radially inward a distance ($d_c$) from a top edge 504*e* of the at least one wall 504. The one or more support members 508 may extend radially inward from the top edge 504*e* a sufficient distance ($d_c$) such that each alignment apertures 512 in the support members 508 aligns with a respective alignment post 112*a* in the cable reel 100' (see, e.g., FIGS. 13A-13B). For example, in some embodiments, each support member 508 may extend radially inward a distance ($d_c$) in the range of about 3 inches to about 10 inches.

Figure 13A:
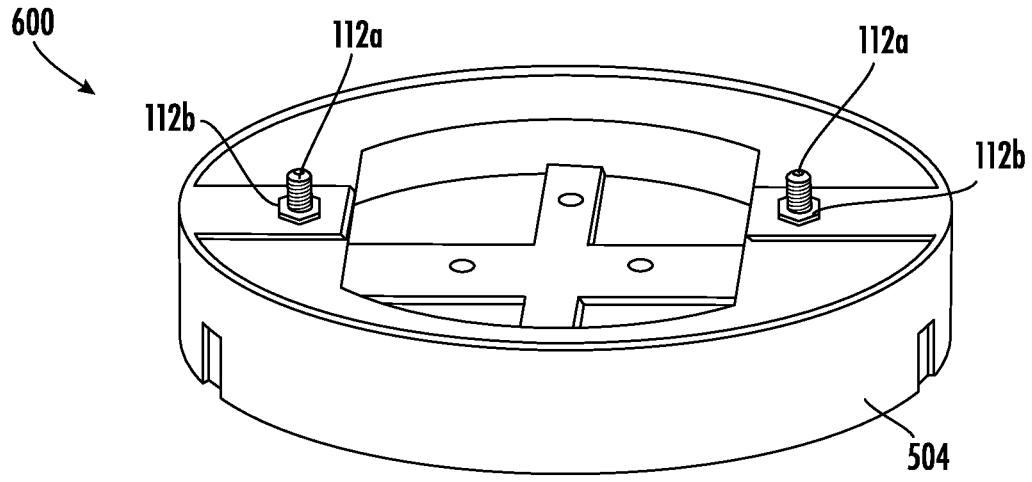
FIG. 13A is a perspective view of a cable reel assembly according to embodiments of the present invention.
Figure 13B:
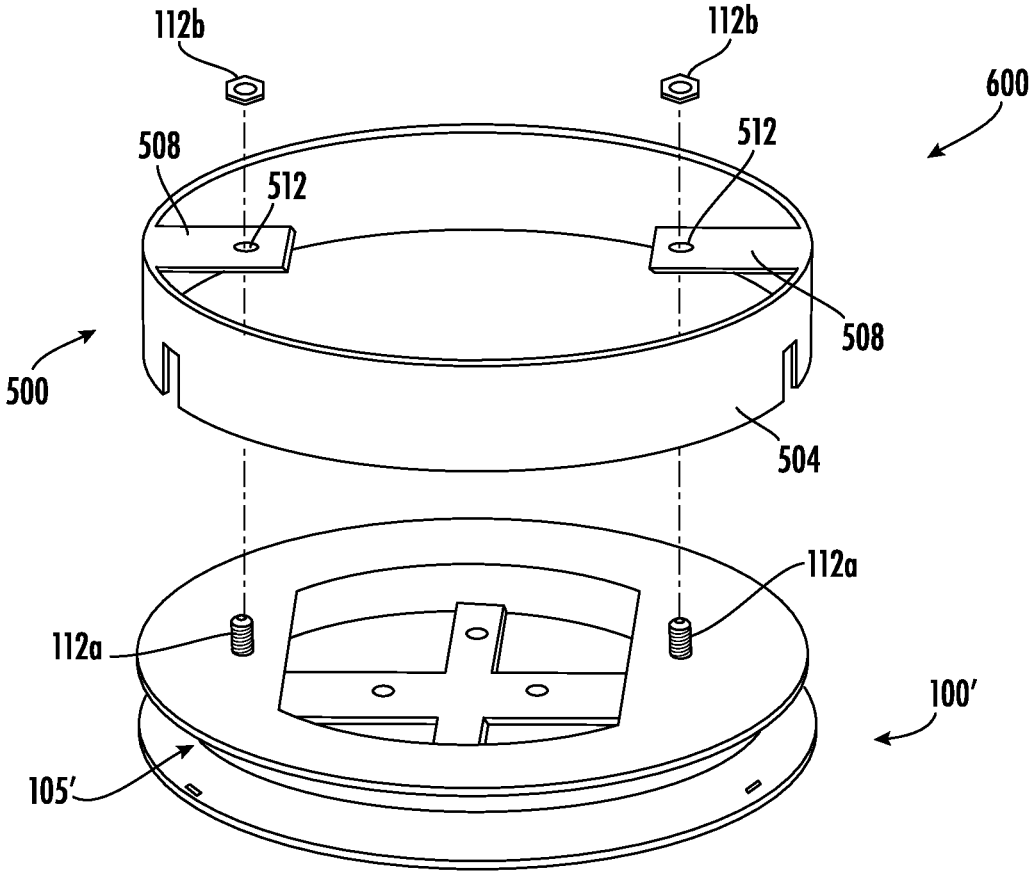
FIG. 13B is an exploded view of the cable reel assembly of FIG. 13A.

Referring now to FIGS. 13A and 13B, a cable reel assembly 600 according to embodiments of the present invention is illustrated. The cable reel assembly 600 may comprise one or more cable reels 100, 100', 200, 300 and one or more cable reel covers 400, 500. As shown in FIGS. 13A-13B, the alignment apertures 512 of a cable reel cover 500 is aligned with the alignment posts 112*a* of a cable reel 100'. As the cable reel cover 500 is placed on the cable reel 100', each alignment post 112*a* of the cable reel 100' is received by a respective alignment aperture 512 of the cable reel cover 500. The cable reel cover 500 is secured to the cable reel 100', for example, by one or more threaded nuts 112*b* threaded onto the alignment posts 112*a*. When placed over the cable reel 100', the at least one wall 504 of the cable reel cover 500 covers the gap 105' of the cable reel 100'.

Figure 14A:
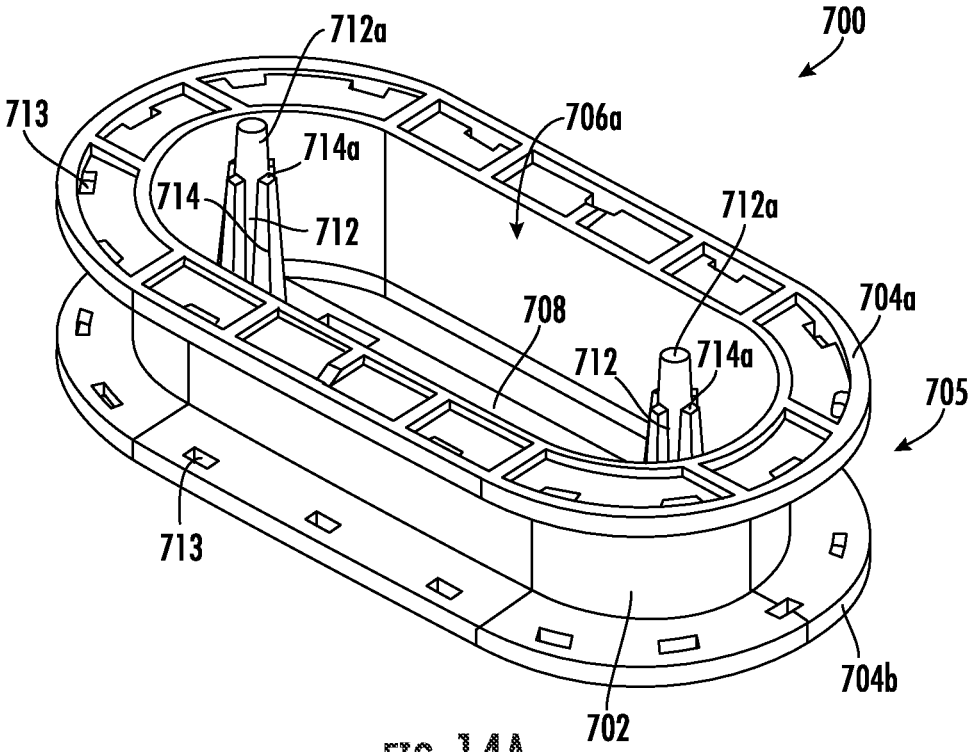
FIG. 14A is a top perspective view of an alternative cable reel according to embodiments of the present invention.
Figure 14B:
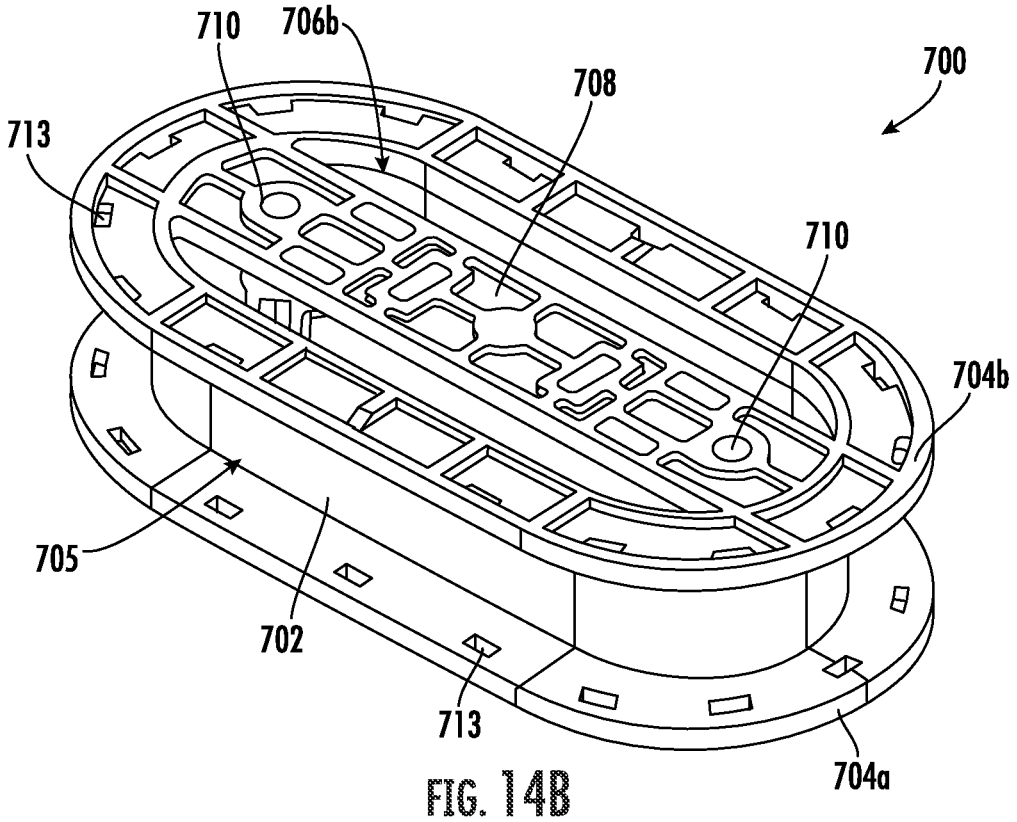
FIG. 14B is a bottom perspective view of the cable reel of FIG. 14A.
Figure 14C:
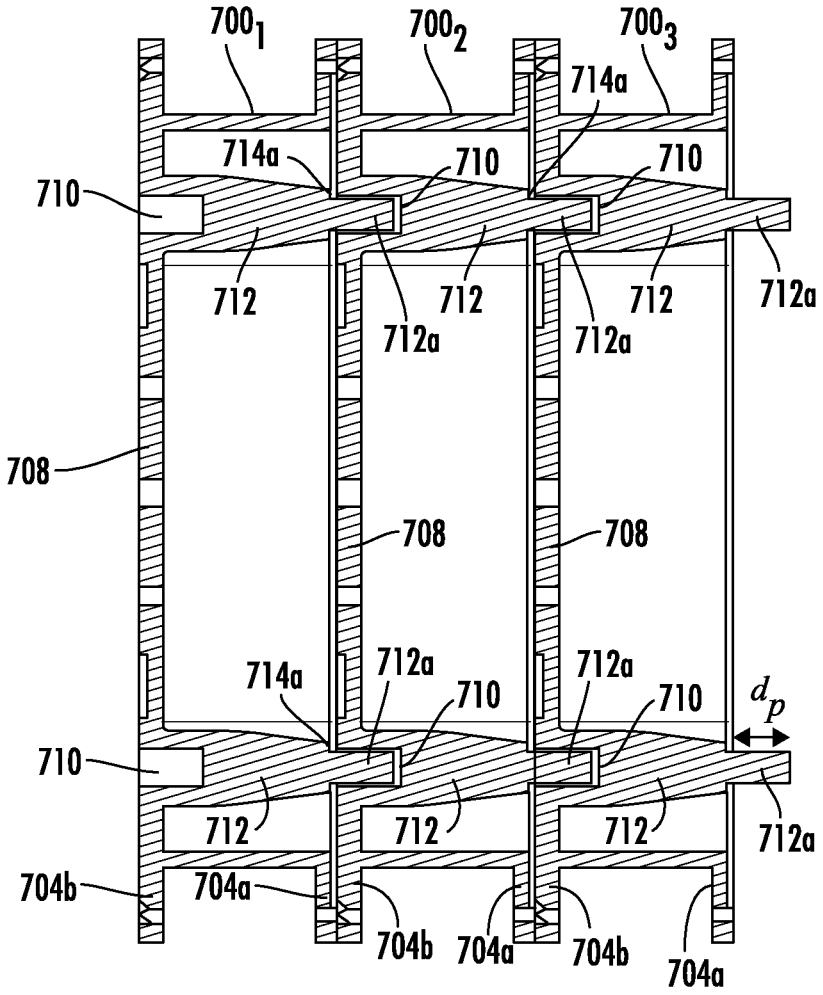
FIG. 14C is a cross-sectional side view of multiple cable reels of FIG. 14A and FIG. 14B stacked together according to embodiments of the present invention.

Referring now to FIGS. 14A-14C, an alternative cable reel 700 according to embodiments of the present invention is illustrated. The cable reel 700 is similar to the cable reel 200 discussed herein except that the support member 708 of the cable reel 700 comprises a pair of posts 712 that are configured such that two or more cable reels 7001-3 may be stacked together. As discussed herein, stacking two or more cable reels 7001-3 together allows for additional excess cable 160 to be stored at or near the mounting structure 150. As shown in FIG. 14A, the posts 712 extend radially inward within the core 702 from a surface of the support member 708. As shown in FIG. 14B, the opposing surface of the support member 708 may comprise a corresponding pair of apertures 710.

As shown in FIG. 14C, in some embodiments, each aperture 710 is configured and sized to receive and form an interference fit with a respective post 712 of another identical cable reel 700, thereby allowing two or more cable reels 7001-3 to be stacked together. For example, as shown in FIG. 14A, in some embodiments, each post 712 may comprise a cylindrical top portion 712*a*. The cylindrical top portion 712*a* may be received by a corresponding circular aperture 710 of an identical cable reel 700. The posts 712 and apertures 710 are sized such that when the top portion 712*a* of the post 712 is inserted into a respective aperture 710 they form an interference fit that holds two cable reels 7001-3 together. Note that the shapes of the top portion 712*a* of the posts 712 and the apertures 710 may be any number of different corresponding shapes, for example, rectangular, star-shaped, or elliptical.

In some embodiments, each post 712 may comprise one or more ribs 714 (see, e.g., FIG. 14A). The ribs 714 may extend along the sides of the posts 712 and up to the top portion 712*a* of the post 712. The ribs 714 protrude radially outward from the sides of the posts 712 such that the tops of the ribs 714 create a shoulder 714*a*. The shoulder(s) 714*a* may prevent the post 712 from being inserted too far into the aperture 710.

In some embodiments, the top portion 712*a* of the posts 712 may comprise two or more slits to form spring-fingers (not shown). When the top portion 712*a* is inserted into the aperture 710 of a second cable reel 700, the spring-fingers press radially outward against an inner surface of the aperture 710, thereby holding the two cable reels 7001-3 together. In some embodiments, the top portion 712*a* of the posts 712 may comprise rubber or like material. The rubber or like material creates additional friction between the top portion 712*a* and the inner surface of the aperture 710 to mitigate or eliminate slippage when two or more cable reels 7001-3 are stacked together.

In some embodiments, the top portion 712*a* extends a distance ($d_p$) above the first wall 704*a* of the cable reel 700. For example, as shown in FIG. 14C, in some embodiments, the top portion 712*a* of the post 712 extends a distance ($d_p$) above the first wall 704*a* that is about equal to the depth of the aperture 710 such that when the top portion 712*a* of the post 712 of one cable reel 700 is received by an aperture 710 of another identical cable reel 700, the first wall 704*a* of the first cable reel 700 is adjacent to the second wall 704*b* of the second cable reel 700.

In some embodiments, the top portion 712*a* of the post 712 may be frangible. In some embodiments, for example, when the cable reel 700 is not being stacked with another cable reel 700, the frangible top portion 712*a* may be broken away such that the cable reel 700 does not have the posts 712 extending above the first wall 704*a*. Thus, the frangible top portion 712*a* is strong enough to be inserted into an aperture 710 and hold two cable reels 700 together without breaking, but also can easily be broken away with, for example, a utility knife.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A cable reel, comprising:

a hollow core having a width;

a first wall coupled to an end of the core and extending radially outward a distance from the core, the first wall comprising an opening aligned with the hollow core and at least one support member extending across the opening;

a second wall coupled to an opposing end of the core and extending radially outwardly a distance from the core, the second wall comprising an opening aligned with the hollow core, wherein the first wall and the second wall form a gap therebetween equal to the width of the core, the gap being configured to hold a length of excess cable wrapped around the core; and a plurality of removable extension flanges coupled to the first and second walls.

2. The cable reel of claim 1, wherein the first wall further comprises at least two stacking tabs and the second wall comprises at least two stacking apertures, the stacking apertures being configured to receive the stacking tabs of a second cable reel.

3. The cable reel of claim 1, wherein the first and second walls further comprise a plurality of lacing apertures.

4. The cable reel of claim 1, wherein the cable reel is mounted on a mounting structure selected from the group consisting of an antenna tower, a waveguide bridge, and a cabinet.

5. The cable reel of claim 1, in combination with a discrete cable, wherein an excess length of the discrete cable is wrapped around the core of the cable reel.

6. The cable reel of claim 1, wherein the first wall of the cable reel further comprises a plurality of mounting apertures or mounting notches configured to mount and secure the cable reel to a mounting structure.

7. A cable reel assembly, comprising:

a cable reel, the cable reel comprising:

a hollow core having a width;

a first wall coupled to an end of the core and extending radially outward a distance from the core, the first wall comprising an opening aligned with the hollow core and at least one support member extending across the opening; and a second wall coupled to an opposing end of the core and extending radially outwardly a distance from the core, the second wall comprising an opening aligned with the hollow core;

wherein the first wall and the second wall form a gap therebetween equal to the width of the core, the gap being configured to hold a length of excess cable wrapped around the core; and a cable reel cover, the cable reel cover comprising:

at least one wall; and one or more support members extending radially inward from a top edge of the at least one wall;

wherein the cable reel cover is configured to fit over the cable reel and cover the gap between the first wall and the second wall of the cable reel.

8. The cable reel assembly of claim 7, wherein the one or more support members extend across the opening of the first wall of the cable reel.

9. The cable reel assembly of claim 7, wherein the cable reel comprises a plurality of alignment posts and the cable reel cover comprises a plurality of alignment apertures, each alignment aperture configured to receive a respective alignment post.

10. The cable reel of claim 7, wherein the first wall further comprises at least two stacking tabs and the second wall comprises at least two stacking apertures, the stacking apertures being configured to receive the stacking tabs of a second cable reel.

11. The cable reel of claim 10, wherein the cable reel is a first cable reel, and wherein the at least two stacking tabs of the first cable reel are received by the at least two stacking apertures of a second cable reel such that second cable reel is secured to the first cable reel in a stacked relationship.

12. The cable reel of claim 7, in combination with a discrete cable, wherein an excess length of the discrete cable is wrapped around the core of the cable reel.

* * * * *